US008407060B2

(12) United States Patent
Hellmuth et al.

(10) Patent No.: US 8,407,060 B2
(45) Date of Patent: Mar. 26, 2013

(54) AUDIO DECODER, AUDIO OBJECT ENCODER, METHOD FOR DECODING A MULTI-AUDIO-OBJECT SIGNAL, MULTI-AUDIO-OBJECT ENCODING METHOD, AND NON-TRANSITORY COMPUTER-READABLE MEDIUM THEREFOR

(75) Inventors: Oliver Hellmuth, Erlangen (DE); Johannes Hilpert, Nuremberg (DE); Leonid Terentiev, Erlangen (DE); Cornelia Falch, Nuremberg (DE); Andreas Hoelzer, Erlangen (DE); Juergen Herre, Buckenhof (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 0 days.

(21) Appl. No.: 13/451,649

(22) Filed: Apr. 20, 2012

(65) Prior Publication Data

US 2012/0213376 A1 Aug. 23, 2012

Related U.S. Application Data

(63) Continuation of application No. 12/253,515, filed on Oct. 17, 2008.

(60) Provisional application No. 60/980,571, filed on Oct. 17, 2007, provisional application No. 60/991,335, filed on Nov. 30, 2007.

(51) Int. Cl.
*G10L 19/00* (2006.01)

(52) U.S. Cl. ..... 704/500; 704/200; 704/200.1; 704/201

(58) Field of Classification Search ..... 704/200–201, 704/500

See application file for complete search history.

(56) References Cited

U.S. PATENT DOCUMENTS

| | | | | |
|---|---|---|---|---|
| 5,912,976 | A | 6/1999 | Klayman et al. | |
| 7,275,031 | B2 * | 9/2007 | Hoerich et al. | 704/230 |
| 7,974,847 | B2 * | 7/2011 | Kjoerling et al. | 704/500 |
| 2002/0035407 | A1 | 3/2002 | Ishito et al. | |
| 2004/0193430 | A1 | 9/2004 | Heo et al. | |
| 2005/0007262 | A1 | 1/2005 | Craven et al. | |
| 2006/0140412 | A1 | 6/2006 | Villemoes et al. | |
| 2006/0165237 | A1 | 7/2006 | Villemoes et al. | |

(Continued)

FOREIGN PATENT DOCUMENTS

| | | | |
|---|---|---|---|
| EP | 1 768 451 | A1 | 3/2007 |
| RU | 2005 123 984 | A | 1/2006 |

(Continued)

OTHER PUBLICATIONS

Official Communication issued in corresponding Japanese Patent Application No. 2010-529293, mailed on Apr. 10, 2012.

(Continued)

*Primary Examiner* — Douglas Godbold
(74) *Attorney, Agent, or Firm* — Keating & Bennett, LLP

(57) ABSTRACT

An audio decoder for decoding a multi-audio-object signal having an audio signal of a first type and an audio signal of a second type encoded therein is described, the multi-audio-object signal having a downmix signal and side information, the side information having level information of the audio signals of the first and second types in a first predetermined time/frequency resolution, and a residual signal specifying residual level values in a second predetermined time/frequency resolution, the audio decoder having a processor for computing prediction coefficients based on the level information; and an up-mixer for up-mixing the downmix signal based on the prediction coefficients and the residual signal to obtain a first up-mix audio signal approximating the audio signal of the first type and/or a second up-mix audio signal approximating the audio signal of the second type.

7 Claims, 18 Drawing Sheets

U.S. PATENT DOCUMENTS

| | | | | |
|---|---|---|---|---|
| 2006/0167683 | A1 | 7/2006 | Hoerich et al. | |
| 2006/0190247 | A1* | 8/2006 | Lindblom | 704/230 |
| 2007/0016427 | A1* | 1/2007 | Thumpudi et al. | 704/500 |
| 2008/0140426 | A1* | 6/2008 | Kim et al. | 704/500 |
| 2009/0125313 | A1* | 5/2009 | Hellmuth et al. | 704/501 |
| 2009/0125314 | A1* | 5/2009 | Hellmuth et al. | 704/501 |
| 2009/0157411 | A1* | 6/2009 | Kim et al. | 704/500 |
| 2009/0164221 | A1* | 6/2009 | Kim et al. | 704/500 |
| 2009/0164222 | A1* | 6/2009 | Kim et al. | 704/500 |
| 2011/0013790 | A1* | 1/2011 | Hilpert et al. | 381/300 |
| 2011/0022402 | A1* | 1/2011 | Engdegard et al. | 704/501 |

FOREIGN PATENT DOCUMENTS

| | | | |
|---|---|---|---|
| TW | 200396713 | B | 7/2000 |
| TW | 405328 | B | 9/2000 |
| TW | I226041 | B | 1/2005 |
| TW | 200627380 | A | 8/2006 |
| TW | 200718034 | A | 5/2007 |
| WO | 2005/086139 | A1 | 9/2005 |
| WO | 2006/103581 | A1 | 10/2006 |

OTHER PUBLICATIONS

Engdegard et al., "Spatial Audio Object Coding (SAOC)—The Upcoming MPEG Standard on Parametric Object Based Audio Coding," Convention Paper 7377, AES 124th Convention, Amsterdam, The Netherlands, May 17-20, 2008, pp. 1-15.

Hellmuth et al.; "Audio decoder, audio object encoder, method for decoding a multi-audio-object signal, multi-audio-object encoding method, and non-transitory computer-readable medium therefor"; U.S. Appl. No. 12/253,515, filed Oct. 17, 2008.

Hellmuth et al.; "Audio Decoding of Multi-Audio-Object Signal using upmixing"; U.S. Appl. No. 12/253,442, filed Oct. 17, 2008.

Official Communication issued in corresponding Taiwanese Patent Application No. 097140089, mailed on Jun. 19, 2012.

Official Communication issued in corresponding Japanese Patent Application No. 2010-529292, mailed on Sep. 4, 2012.

Herre et al., New Concepts in Parametric Coding of Spatial Audio: From SAC to SAOC, Multimedia and EXPO, IEEE International Conference, Jul. 1, 2007, pp. 1894-1897.

Official Communication issued in corresponding Taiwanese Patent Application No. 10121430380, mailed on Dec. 17, 2012.

* cited by examiner

Syntax of SAOCSpecificConfig()

| Syntax | No. of bits | Mnemonic |
|---|---|---|
| SAOCSpecificConfig() | | |
| { | | |
| bsSamplingFrequencyIndex; | 4 | uimsbf |
| if (bsSamplingFrequencyIndex == 15 { | | |
| bsSamplingFrequency; | 24 | uimsbf |
| } | | |
| bsFreqRes; | 3 | uimsbf |
| bsFrameLength; | 7 | uimsbf |
| frameLength=bsFrameLength + 1; | | |
| bsNumObjects; | 5 | uimsbf |
| numObjects = bsNumObjects +1; | | |
| for (i=0; i<numObjects; i++) { | | |
| objectIsGrouped[i] = 0; | | |
| } | | |
| for (i=0; i<numObjects; i++){ | | |
| bsRelatedTo[i][i] = 1; | | |
| for (j=i+1; j<numObjects; j++){ | | |
| if (!objectIsGrouped[j] && !bsRelatedTo[i][j]) { | | |
| bsRelatedTo[i][j]; | 1 | uimsbf |
| bsRelatedTo[j][i] = bsRelatedTo[i][j]; | | |
| if (bsRelatedTo[i][j] == 1) { | | |
| objectIsGrouped[i]=1; | | |
| objectIsGrouped[j]=1; | | |
| for (k=i; k<j; k++){ | | |
| if (bsRelatedTo[i][k] == 1){ | | |
| bsRelatedTo[j][k] = 1; | | |
| bsRelatedTo[k][j] = 1; | | |
| } | | |
| } | | |
| } | | |
| } | | |
| } | | |
| } | | |
| bsTransmitAbsNrg; | 1 | uimsbf |
| bsNumDmxChannels; | 1 | uimsbf |
| numDmxChannels = bsNumDmxChannels + 1; | | |
| if (numDmxChannels == 2) { | | |
| bsTttDualMode; | 1 | uimsbf |
| if (bsTttDualMode) { | | |
| bsTttBandsLow; | 5 | uimsbf |
| } | | |
| else { | | |
| bsTttBandsLow = numBands; | | Note 1 |
| } | | |
| } | | |
| bsObjectMetaDataAvailable; | 1 | uimsbf |
| if (bsObjectMetaDataAvailable) { | | |
| ObjectMetaData (numObjects); | | |
| } | | |
| bsReseved; | 2 | uimsbf |
| ByteAlign(); | | |
| SAOCExtensionConfig(); | | |
| } | | |
| Note 1: numBands is defined in and depends on bsFreqRes. | | |

FIG 13A

Syntax of SAOCExtensionConfig()

| Syntax | No. of bits | Mnemonic |
|---|---|---|
| SAOCExtensionConfig() | | |
| { | | |
| sacExtNum = 0; | | |
| while (BitsAvailable()>=8){ | | Note 1 |
| bsSacExtType; | 4 | uimsbf |
| sacExtType[sacExtNum] = bsSacExtType; | | |
| sacExtNum++; | | |
| cnt = bs SacExtLen; | 4 | uimsbf |
| if (cnt==15){ | | |
| cnt+=bsSacExtLenAdd; | 8 | uimsbf |
| } | | |
| if (cnt==15+255){ | | |
| cnt+=bsSacExtLenAddAdd; | 16 | uimsbf |
| } | | |
| bitsRead = SAOCExtensionConfigData(bsSacExtType) | | Note 2 |
| nFillBits = 8*cnt-bitsRead; | | |
| bsFillBits; | nFillBits | bslbf |
| } | | |
| } | | |
| } | | |

Note1:The function BitsAvailable() returns the number of bits available to be read.
Note2: SAOCExtensionConfigData() returns the number of bits read.

FIG 13B

Syntax of SAOCExtensionConfigData(0)

| Syntax | No. of bits | Mnemonic |
|---|---|---|
| SAOCExtensionConfigData(0) | | |
| { | | |
| bsResidualSamplingFrequencyIndex; | 4 | uimsbf |
| bsResidualFramesPerSAOCFrame; | 2 | uimsbf |
| bsNumGroupsFGO; | 2 | uimsbf |
| NumGroupsFGO = bsNumGroupsFGO + 1; | | |
| for (i=0;i<NumGroupsFGO; i++){ | | |
| ResidualConfig(i); | | |
| } | | |
| } | | |
| Note 1: numOttBoxes and numTttBoxes are defined by depend on bsTreeConfig. | | |

FIG 13C

Table 1 - Syntax of ResidualConfig()

| Syntax | No. of bits | Mnemonic |
|---|---|---|
| ResidualConfig(i) | | |
| { | | |
| bsResidualPresent[i]; | 1 | uimsbf |
| if (bsResidualPresent[i]) { | | |
| bsResidualBands[i]; | 5 | uimsbf |
| } | | |
| } | | |

FIG 13D

Syntax of SAOCFrame()

| Syntax | No. of bits | Mnemonic |
|---|---|---|
| SAOCFrame() | | |
| { | | |
| FramingInfo; | | Note 1 |
| bsIndependencyFlag; | 1 | uimsbf |
| startBand = 0; | | |
| for (i=0;i<numObjects; i++){ | | |
| [oId[i],oIdQuantCoarse[i], oIdFreqResStride[i]] = | | Notes 2,3 |
| EcData(t_OLD,prevOIdQuantCoarse[i], prevOIdFreqResStride[i], | | |
| numParamSets, bsIndependencyFlag, startBand, numBands); | | |
| } | | |
| if (bsTransmitAbsNrg) { | | |
| [nrg, nrgQuantCoarse, nrgFreqResStride] = | | Notes 2, 3 |
| EcData(t_NRG, prevNrgQuantCoarse, prevNrgFreqResStride, | | |
| numParamSets, bsIndependencyFlag, startBand, numBands); | | |
| } | | |
| for (i=0;i<numObjects; i++){ | | |
| for (j=i+1;j<numObjects; j++) { | | |
| if (bsRelatedTo[i][j]!=0){ | | |
| [iocc[i][j], iocQuantCoarse[i][j], iocFreqResStride[i][j] = | | Notes 2,3 |
| EcData(t_ICC, prevIocQuantCoarse[i][j], | | |
| prevIocFreqResStride[i][j], numParamSets, | | |
| bsIndependencyFlag, startBand, numBands); | | |
| } | | |
| } | | |
| } | | |
| firstObject = 0; | | |
| [dmg, dmgQuantCoarse, dmgFreqResStride] = | | |
| EcData (t_CLD, prevDmgQuantCoarse, prevIocFreqResStride, | | |
| numParamSets, bsIndependencyFlag, firstObject, numObjects); | | |
| if (numDmxChannels > 1){ | | |
| [cld, cldQuantCoarse, cldFreqResStride] = | | |
| EcData (t_CLD, prevCldQuantCoarse, prevCldFreqResStride, | | |
| numParamSets, bsIndependencyFlag, firstObject, numObjects); | | |
| } | | |
| ByteAlign(); | | |
| SAOCExtensionFrame(); | | |
| } | | |

Note 1: FramingInfo() is defined in ISO/IEC FDIS 23003-1:2006, Table 16.
Note 2: EcData() is defined in ISO/IEC FDIS 23003-1:2006, Table 23.
Note 3: numBands is defined in ISO/IEC FDIS 23003-1:2006, Table 39, and depends on bsFreqRes.

FIG 13E

Syntax of SAOCExtensionFrame()

| Syntax | No. of bits | Mnemonic |
|---|---|---|
| SAOCExtensionFrame() | | |
| { | | |
| for (ec=0; ec<sacExtNum; ec++){ | | |
| if (sacExtType[ec]<12) { | | |
| cnt=bsSacExtLen; | 8 | uimsbf |
| if(cnt==255){ | | |
| cnt+=bsSacExtLenAdd; | 16 | uimsbf |
| } | | |
| bitsRead=SAOCExtensionFrameData(sacExtType[ec]) | | Note1 |
| nFillBits = 8*cnt-bitsRead; | | |
| bsFillBits; | nFillBits | bslbf |
| } | | |
| } | | |
| } | | |
| Note1: SAOCExtensionFrameData() returns the number of bits read. | | |

FIG 13F

Table 2 - Syntax of SAOCExtensionFrameData(0)

| Syntax | No. of bits | Mnemonic |
|---|---|---|
| SAOCExtensionFrameData(0) | | |
| { | | |
| ResidualData () | | |
| } | | |

FIG 13G

Syntax of ResidualData()

| Syntax | No. of bits | Mnemonic |
|---|---|---|
| ResidualData() | | |
| { | | |
| for (i=0; i<numOttBoxes+numTttBoxes;i++){ | | |
| if (bsResidualPresent[i]) { | | |
| tempExtraFrame=numSlots/(bsResidualFramesPerSAOCFrame+1); | | Note 4 |
| for (rf=0;rf<bsResidualFramesPerSAOCFrame; rf++) | | |
| individual_channel_stream(0); | | Note 1 |
| if (window_sequence == EIGT_SHORT_SEQUENCE) && | | Note 5 |
| ((tempExtraFrame == 18)\|\|(tempExtraFrame == 24)\|\| | | |
| (tempExtraFrame == 30)) { | | |
| individual_channel_stream(0); | | Note 1 |
| } | | |
| } | | |
| } | | |
| } | | |
| } | | |

Note 1: individual_channel_stream (0) according to MPEG-2 AAC Low Complexity profile bitstream syntax described in subclause 6.3 of ISO/IEC 13818-7.
Note 2: numParamSets is defined by numParamSets = bsNumParamSets + 1.
Note 3: 1Dhuff_dec() is defined in Annex
Note 4: numSlots is defined by numSlots = bsFrameLength +1. Furthermore the division shall be interpreted as ANSI C integer division.
Note 5: individual_channel_stream(0) determines the value of window_sequence.

FIG 13H

Table 1 - Syntax of ResidualConfig()

| Syntax | No. of bits | Mnemonic |
|---|---|---|
| ResidualConfig() | | |
| { | | |
| bsResidualSamplingFrequencyIndex; | 4 | uimsbf |
| bsResidualFramesPerSAOCFrame; | 2 | uimsbf |
| bsNumGroupsFGO; | 2 | uimsbf |
| NumGroupsFGO = bsNumGroupsFGO + 1; | | |
| for (i=0; i<NumGroupsFGO;I++) { | | |
| bsResidualPresent[i]; | 1 | uimsbf |
| if ( bsResidualPresent[i]) { | | |
| bsResidualBands[i]; | 5 | uimsbf |
| } | | |
| } | | |
| } | | |

FIG 15

AUDIO DECODER, AUDIO OBJECT ENCODER, METHOD FOR DECODING A MULTI-AUDIO-OBJECT SIGNAL, MULTI-AUDIO-OBJECT ENCODING METHOD, AND NON-TRANSITORY COMPUTER-READABLE MEDIUM THEREFOR

CROSS-REFERENCE TO RELATED APPLICATIONS

This application claims priority from Provisional U.S. Patent Application No. 60/980,571, which was filed on Oct. 17, 2007, and from Provisional U.S. Patent Application No. 60/991,335, which was filed on Nov. 30, 2007, which are both incorporated herein in their entirety by reference.

BACKGROUND OF THE INVENTION

The present application is concerned with audio coding using down-mixing of signals.

Many audio encoding algorithms have been proposed in order to effectively encode or compress audio data of one channel, i.e., mono audio signals. Using psychoacoustics, audio samples are appropriately scaled, quantized or even set to zero in order to remove irrelevancy from, for example, the PCM coded audio signal. Redundancy removal is also performed.

As a further step, the similarity between the left and right channel of stereo audio signals has been exploited in order to effectively encode/compress stereo audio signals.

However, upcoming applications pose further demands on audio coding algorithms. For example, in teleconferencing, computer games, music performance and the like, several audio signals which are partially or even completely uncorrelated have to be transmitted in parallel. In order to keep the bit rate for encoding these audio signals low enough in order to be compatible to low-bit rate transmission applications, recently, audio codecs have been proposed which downmix the multiple input audio signals into a downmix signal, such as a stereo or even mono downmix signal. For example, the MPEG Surround standard downmixes the input channels into the downmix signal in a manner prescribed by the standard. The downmixing is performed by use of so-called $OTT^{-1}$ and $TTT^{-1}$ boxes for downmixing two signals into one and three signals into two, respectively. In order to downmix more than three signals, a hierarchic structure of these boxes is used. Each $OTT^{-1}$ box outputs, besides the mono downmix signal, channel level differences between the two input channels, as well as inter-channel coherence/cross-correlation parameters representing the coherence or cross-correlation between the two input channels. The parameters are output along with the downmix signal of the MPEG Surround coder within the MPEG Surround data stream. Similarly, each $TTT^{-1}$ box transmits channel prediction coefficients enabling recovering the three input channels from the resulting stereo downmix signal. The channel prediction coefficients are also transmitted as side information within the MPEG Surround data stream. The MPEG Surround decoder upmixes the downmix signal by use of the transmitted side information and recovers, the original channels input into the MPEG Surround encoder.

However, MPEG Surround, unfortunately, does not fulfill all requirements posed by many applications. For example, the MPEG Surround decoder is dedicated for upmixing the downmix signal of the MPEG Surround encoder such that the input channels of the MPEG Surround encoder are recovered as they are. In other words, the MPEG Surround data stream is dedicated to be played back by use of the loudspeaker configuration having been used for encoding.

However, according to some implications, it would be favorable if the loudspeaker configuration could be changed at the decoder's side.

In order to address the latter needs, the spatial audio object coding (SAOC) standard is currently designed. Each channel is treated as an individual object, and all objects are downmixed into a downmix signal. However, in addition the individual objects may also comprise individual sound sources as e.g. instruments or vocal tracks. However, differing from the MPEG Surround decoder, the SAOC decoder is free to individually upmix the downmix signal to replay the individual objects onto any loudspeaker configuration. In order to enable the SAOC decoder to recover the individual objects having been encoded into the SAOC data stream, object level differences and, for objects forming together a stereo (or multichannel) signal, inter-object cross correlation parameters are transmitted as side information within the SAOC bitstream. Besides this, the SAOC decoder/transcoder is provided with information revealing how the individual objects have been downmixed into the downmix signal. Thus, on the decoder's side, it is possible to recover the individual SAOC channels and to render these signals onto any loudspeaker configuration by utilizing user-controlled rendering information.

However, although the SAOC codec has been designed for individually handling audio objects, some applications are even more demanding. For example, Karaoke applications necessitate a complete separation of the background audio signal from the foreground audio signal or foreground audio signals. Vice versa, in the solo mode, the foreground objects have to be separated from the background object. However, owing to the equal treatment of the individual audio objects it was not possible to completely remove the background objects or the foreground objects, respectively, from the downmix signal.

SUMMARY

According to an embodiment, an audio decoder for decoding a multi-audio-object signal having an audio signal of a first type and an audio signal of a second type encoded therein, the multi-audio-object signal having a downmix signal and side information, the side information having level information of the audio signal of the first type and the audio signal of the second type in a first predetermined time/frequency resolution, and a residual signal specifying residual level values in a second predetermined time/frequency resolution, may have a processor for computing prediction coefficients based on the level information; and an up-mixer for up-mixing the downmix signal based on the prediction coefficients and the residual signal to acquire a first up-mix audio signal approximating the audio signal of the first type and/or a second up-mix audio signal approximating the audio signal of the second type.

According to another embodiment, an audio object encoder may have: a processor for computing level information of an audio signal of the first type and an audio signal of the second type in a first predetermined time/frequency resolution; a processor for computing prediction coefficients based on the level information; a downmixer for downmixing the audio signal of the first type and the audio signal of the second type to acquire a downmix signal; a setter for setting a residual signal specifying residual level values at a second predetermined time/frequency resolution such that up-mixing the downmix signal based on both the prediction coefficients and the residual signal results in a first up-mix audio signal approximating the audio signal of the first type and a second up-mix audio signal approximating the audio signal of the second type, the approximation being improved compared to the absence of the residual signal, the level information and the residual signal being included by a side information forming, along with the downmix signal, a multi-audio-object signal.

According to another embodiment, a method for decoding a multi-audio-object signal having an audio signal of a first type and an audio signal of a second type encoded therein, the multi-audio-object signal having a downmix signal and side information, the side information having level information of the audio signal of the first type and the audio signal of the second type in a first predetermined time/frequency resolution, and a residual signal specifying residual level values in a second predetermined time/frequency resolution, may have the steps of computing prediction coefficients based on the level information; and up-mixing the downmix signal based on the prediction coefficients and the residual signal to acquire a first up-mix audio signal approximating the audio signal of the first type and/or a second up-mix audio signal approximating the audio signal of the second type.

According to another embodiment, a multi-audio-object encoding method may have the steps of: computing level information of an audio signal of the first type and an audio signal of the second type in a first predetermined time/frequency resolution; computing prediction coefficients based on the level information; downmixing the audio signal of the first type and the audio signal of the second type to acquire a downmix signal; setting a residual signal specifying residual level values at a second predetermined time/frequency resolution such that up-mixing the downmix signal based on both the prediction coefficients and the residual signal results in a first up-mix audio signal approximating the audio signal of the first type and a second up-mix audio signal approximating the audio signal of the second type, the approximation being improved compared to the absence of the residual signal, the level information and the residual signal being included by a side information forming, along with the downmix signal, a multi-audio-object signal.

According to another embodiment, a program may have a program code for executing, when running on a processor, a method for decoding a multi-audio-object signal having an audio signal of a first type and an audio signal of a second type encoded therein, the multi-audio-object signal having a downmix signal and side information, the side information having level information of the audio signal of the first type and the audio signal of the second type in a first predetermined time/frequency resolution, and a residual signal specifying residual level values in a second predetermined time/frequency resolution, wherein the method may have the steps of computing prediction coefficients based on the level information; and up-mixing the downmix signal based on the prediction coefficients and the residual signal to acquire a first up-mix audio signal approximating the audio signal of the first type and/or a second up-mix audio signal approximating the audio signal of the second type.

According to another embodiment, a program may have a program code for executing, when running on a processor, a multi-audio-object encoding method, wherein the method may have the steps of: computing level information of an audio signal of the first type and an audio signal of the second type in a first predetermined time/frequency resolution; computing prediction coefficients based on the level information; downmixing the audio signal of the first type and the audio signal of the second type to acquire a downmix signal; setting a residual signal specifying residual level values at a second predetermined time/frequency resolution such that up-mixing the downmix signal based on both the prediction coefficients and the residual signal results in a first up-mix audio signal approximating the audio signal of the first type and a second up-mix audio signal approximating the audio signal of the second type, the approximation being improved compared to the absence of the residual signal, the level information and the residual signal being included by a side information forming, along with the downmix signal, a multi-audio-object signal.

According to another embodiment, a multi-audio-object signal may have an audio signal of a first type and an audio signal of a second type encoded therein, the multi-audio-object signal having a downmix signal and side information, the side information having level information of the audio signal of the first type and the audio signal of the second type in a first predetermined time/frequency resolution, and a residual signal specifying residual level values in a second predetermined time/frequency resolution, wherein the residual signal is set such that computing prediction coefficients based on the level information and up-mixing the downmix signal based on the prediction coefficients and the residual signal results in a first up-mix audio signal approximating the audio signal of the first type and a second up-mix audio signal approximating the audio signal of the second type.

BRIEF DESCRIPTION OF THE DRAWINGS

Embodiments of the present invention will be detailed subsequently referring to the appended drawings, in which:

FIG. 13*a* to *h* show tables reflecting a possible syntax for the SOAC bitstream according to an embodiment of the present invention;

FIG. 15 show a table reflecting a possible syntax for signaling the amount of data spent for transferring the residual signal.

DETAILED DESCRIPTION OF THE INVENTION

Before embodiments of the present invention are described in more detail below, the SAOC codec and the SAOC parameters transmitted in an SAOC bitstream are presented in order to ease the understanding of the specific embodiments outlined in further detail below.

Figure 1:
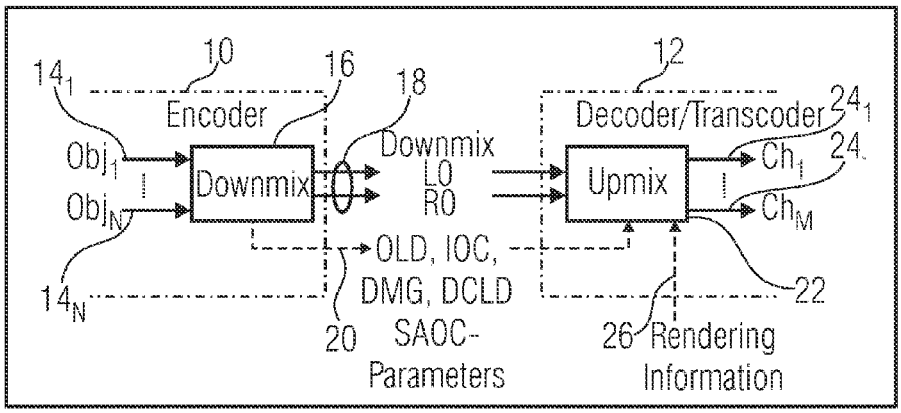
FIG. 1 shows a block diagram of an SAOC encoder/decoder arrangement in which the embodiments of the present invention may be implemented.

FIG. 1 shows a general arrangement of an SAOC encoder 10 and an SAOC decoder 12. The SAOC encoder 10 receives as an input N objects, i.e., audio signals $\mathbf{14}_1$ to $\mathbf{14}_N$. In particular, the encoder 10 comprises a downmixer 16 which receives the audio signals $\mathbf{14}_1$ to $\mathbf{14}_N$ and downmixes same to a downmix signal 18. In FIG. 1, the downmix signal is exemplarily shown as a stereo downmix signal. However, a mono downmix signal is possible as well. The channels of the stereo downmix signal 18 are denoted L0 and R0, in case of a mono downmix same is simply denoted L0. In order to enable the SAOC decoder 12 to recover the individual objects $\mathbf{14}_1$ to $\mathbf{14}_N$, downmixer 16 provides the SAOC decoder 12 with side information including SAOC-parameters including object level differences (OLD), inter-object cross correlation parameters (IOC), downmix gain values (DMG) and downmix channel level differences (DCLD). The side information 20 including the SAOC-parameters, along with the downmix signal 18, forms the SAOC output data stream received by the SAOC decoder 12.

The SAOC decoder 12 comprises an upmixer 22 which receives the downmix signal 18 as well as the side information 20 in order to recover and render the audio signals $\mathbf{14}_1$ and $\mathbf{14}_N$ onto any user-selected set of channels $\mathbf{24}_1$ to $\mathbf{24}_M$, with the rendering being prescribed by rendering information 26 input into SAOC decoder 12.

The audio signals $\mathbf{14}_1$ to $\mathbf{14}_N$ may be input into the downmixer 16 in any coding domain, such as, for example, in time or spectral domain. In case, the audio signals $\mathbf{14}_1$ to $\mathbf{14}_N$ are fed into the downmixer 16 in the time domain, such as PCM coded, downmixer 16 uses a filter bank, such as a hybrid QMF bank, i.e., a bank of complex exponentially modulated filters with a Nyquist filter extension for the lowest frequency bands to increase the frequency resolution therein, in order to transfer the signals into spectral domain in which the audio signals are represented in several subbands associated with different spectral portions, at a specific filter bank resolution. If the audio signals $\mathbf{14}_1$ to $\mathbf{14}_N$ are already in the representation expected by downmixer 16, same does not have to perform the spectral decomposition.

Figure 2:
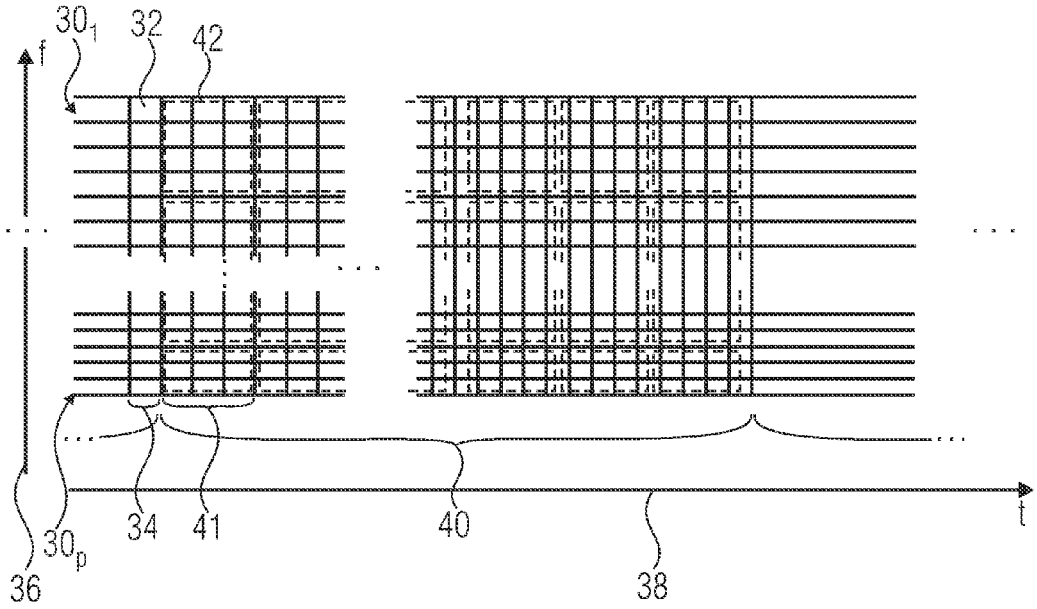
FIG. 2 shows a schematic and illustrative diagram of a spectral representation of a mono audio signal.

FIG. 2 shows an audio signal in the just-mentioned spectral domain. As can be seen, the audio signal is represented as a plurality of subband signals. Each subband signal $\mathbf{30}_1$ to $\mathbf{30}_P$ consists of a sequence of subband values indicated by the small boxes 32. As can be seen, the subband values 32 of the subband signals $\mathbf{30}_1$ to $\mathbf{30}_P$ are synchronized to each other in time so that for each of consecutive filter bank time slots 34 each subband $\mathbf{30}_1$ to $\mathbf{30}_P$ comprises exact one subband value 32. As illustrated by the frequency axis 36, the subband signals $\mathbf{30}_1$ to $\mathbf{30}_P$ are associated with different frequency regions, and as illustrated by the time axis 38, the filter bank time slots 34 are consecutively arranged in time.

As outlined above, downmixer 16 computes SAOC-parameters from the input audio signals $\mathbf{14}_1$ to $\mathbf{14}_N$. Downmixer 16 performs this computation in a time/frequency resolution which may be decreased relative to the original time/frequency resolution as determined by the filter bank time slots 34 and subband decomposition, by a certain amount, with this certain amount being signaled to the decoder side within the side information 20 by respective syntax elements bsFrameLength and bsFreqRes. For example, groups of consecutive filter bank time slots 34 may form a frame 40. In other words, the audio signal may be divided-up into frames overlapping in time or being immediately adjacent in time, for example. In this case, bsFrameLength may define the number of parameter time slots 41, i.e. the time unit at which the SAOC parameters such as OLD and IOC, are computed in an SAOC frame 40 and bsFreqRes may define the number of processing frequency bands for which SAOC parameters are computed. By this measure, each frame is divided-up into time/frequency tiles exemplified in FIG. 2 by dashed lines 42.

The downmixer 16 calculates SAOC parameters according to the following formulas. In particular, downmixer 16 computes object level differences for each object i as $$OLD_i = \frac{\sum_n \sum_{k \in m} x_i^{n,k} x_i^{n,k*}}{\max_j \left( \sum_n \sum_{k \in m} x_j^{n,k} x_j^{n,k*} \right)}$$

wherein the sums and the indices n and k, respectively, go through all filter bank time slots 34, and all filter bank subbands 30 which belong to a certain time/frequency tile 42. Thereby, the energies of all subband values $x_i$ of an audio signal or object i are summed up and normalized to the highest energy value of that tile among all objects or audio signals.

Further the SAOC downmixer 16 is able to compute a similarity measure of the corresponding time/frequency tiles of pairs of different input objects $\mathbf{14}_1$ to $\mathbf{14}_N$. Although the SAOC downmixer 16 may compute the similarity measure between all the pairs of input objects $\mathbf{14}_1$ to $\mathbf{14}_N$, downmixer 16 may also suppress the signaling of the similarity measures or restrict the computation of the similarity measures to audio objects $\mathbf{14}_1$ to $\mathbf{14}_N$ which form left or right channels of a common stereo channel. In any case, the similarity measure is called the inter-object cross-correlation parameter $IOC_{i,j}$. The computation is as follows $$IOC_{i,j} = IOC_{j,i} = Re\left\{ \frac{\sum_n \sum_{k \in m} x_i^{n,k} x_j^{n,k*}}{\sqrt{\sum_n \sum_{k \in m} x_i^{n,k} x_i^{n,k*} \sum_n \sum_{k \in m} x_j^{n,k} x_j^{n,k*}}} \right\}$$

with again indexes n and k going through all subband values belonging to a certain time/frequency tile 42, and i and j denoting a certain pair of audio objects $\mathbf{14}_1$ to $\mathbf{14}_N$.

The downmixer 16 downmixes the objects $\mathbf{14}_1$ to $\mathbf{14}_N$ by use of gain factors applied to each object $\mathbf{14}_1$ to $\mathbf{14}_N$. That is, a gain factor $D_i$ is applied to object i and then all thus weighted objects $\mathbf{14}_1$ to $\mathbf{14}_N$ are summed up to obtain a mono downmix signal. In the case of a stereo downmix signal, which case is exemplified in FIG. 1, a gain factor $D_{1,i}$ is applied to object i and then all such gain amplified objects are summed-up in order to obtain the left downmix channel L0, and gain factors $D_{2,i}$ are applied to object i and then the thus gain-amplified objects are summed-up in order to obtain the right downmix channel R0.

This downmix prescription is signaled to the decoder side by means of down mix gains $DMG_i$ and, in case of a stereo downmix signal, downmix channel level differences $DCLD_i$.

The downmix gains are calculated according to:

$$DMG_i=20\log_{10}(D_i+\epsilon),\ \text{(mono downmix)},$$

$$DMG_i=10\log_{10}(D_{1,i}^2+D_{2,i}^2+\epsilon),\ \text{(stereo downmix)},$$

where $\epsilon$ is a small number such as $10^{-9}$.

For the $DCLD_s$ the following formula applies:

$$DCLD_i = 20\log_{10}\left(\frac{D_{1,i}}{D_{2,i}+\varepsilon}\right).$$

In the normal mode, downmixer 16 generates the downmix signal according to:

$$(L0) = (D_i)\begin{pmatrix} Obj_1 \\ \vdots \\ Obj_N \end{pmatrix}$$

for a mono downmix, or $$\begin{pmatrix} L0 \\ R0 \end{pmatrix} = \begin{pmatrix} D_{1,i} \\ D_{2,i} \end{pmatrix}\begin{pmatrix} Obj_1 \\ \vdots \\ Obj_N \end{pmatrix}$$

for a stereo downmix, respectively.

Thus, in the abovementioned formulas, parameters OLD and IOC are a function of the audio signals and parameters DMG and DCLD are a function of D. By the way, it is noted that D may be varying in time.

Thus, in the normal mode, downmixer 16 mixes all objects $\mathbf{14}_1$ to $\mathbf{14}_N$ with no preferences, i.e., with handling all objects $\mathbf{14}_1$ to $\mathbf{14}_N$ equally.

The upmixer 22 performs the inversion of the downmix procedure and the implementation of the "rendering information" represented by matrix A in one computation step, namely $$\begin{pmatrix} Ch_1 \\ \vdots \\ Ch_M \end{pmatrix} = AED^{-1}(DED^{-1})^{-1}\begin{pmatrix} L0 \\ R0 \end{pmatrix},$$

where matrix E is a function of the parameters OLD and IOC.

In other words, in the normal mode, no classification of the objects $\mathbf{14}_1$ to $\mathbf{14}_N$ into BGO, i.e., background object, or FGO, i.e., foreground object, is performed. The information as to which object shall be presented at the output of the upmixer 22 is to be provided by the rendering matrix A. If, for example, object with index 1 was the left channel of a stereo background object, the object with index 2 was the right channel thereof, and the object with index 3 was the foreground object, then rendering matrix A would be $$\begin{pmatrix} Obj_1 \\ Obj_2 \\ Obj_3 \end{pmatrix} \equiv \begin{pmatrix} BGO_L \\ BGO_R \\ FGO \end{pmatrix} \rightarrow A = \begin{pmatrix} 1 & 0 & 0 \\ 0 & 1 & 0 \end{pmatrix}$$

to produce a Karaoke-type of output signal.

However, as already indicated above, transmitting BGO and FGO by use of this normal mode of the SAOC codec does not achieve acceptable results.

Figure 3:
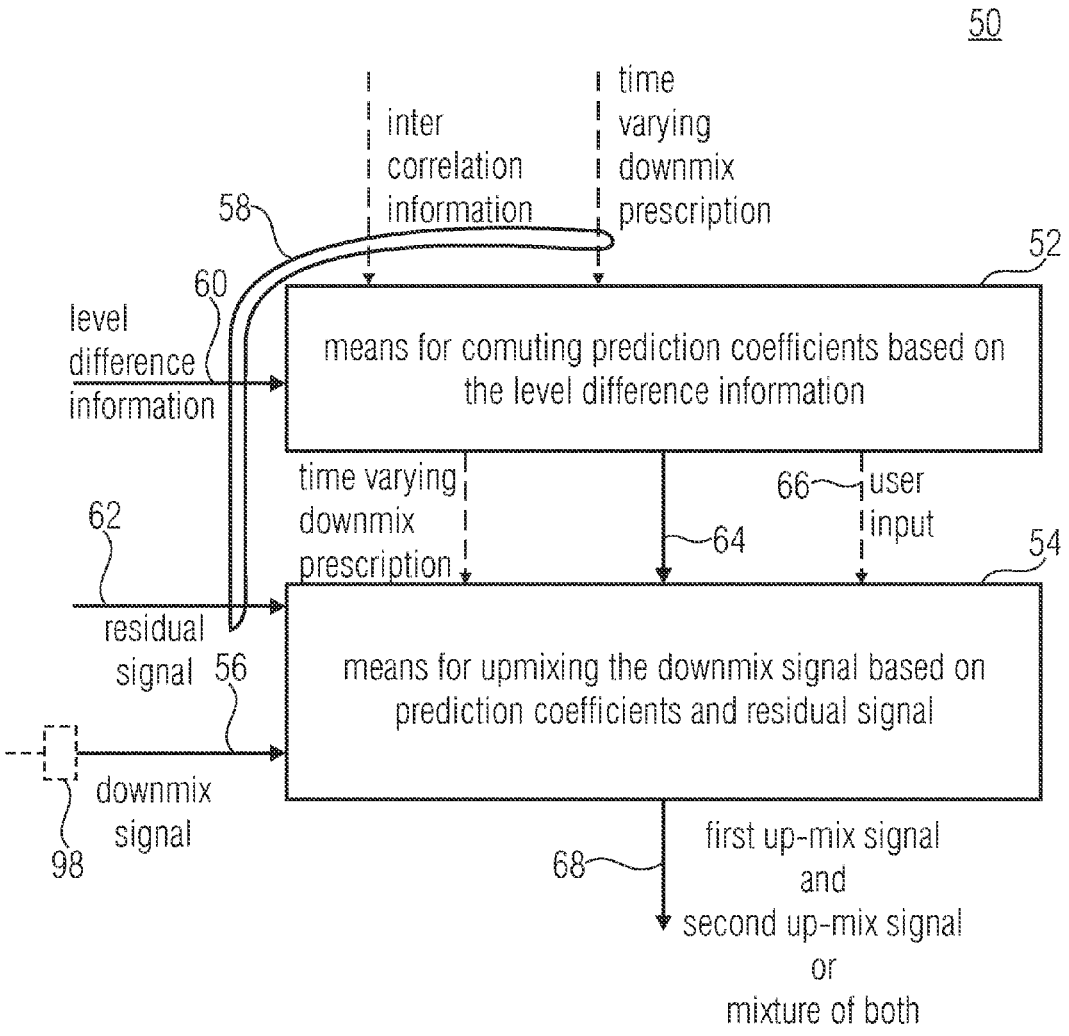
FIG. 3 shows a block diagram of an audio decoder according to an embodiment of the present invention.
Figure 4:
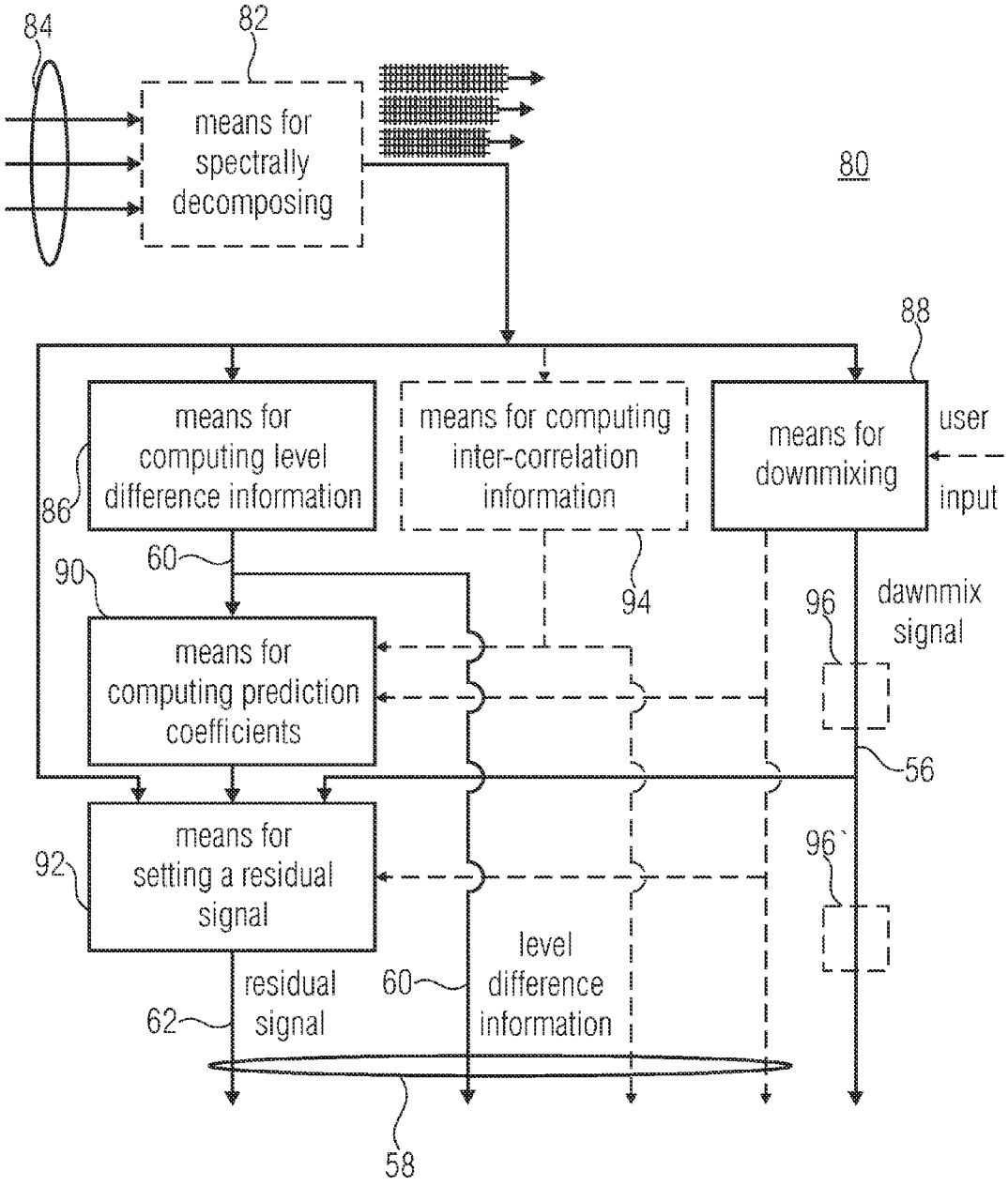
FIG. 4 shows a block diagram of an audio encoder according to an embodiment of the present invention.

FIGS. 3 and 4, describe an embodiment of the present invention which overcomes the deficiency just described. The decoder and encoder described in these Figs. and their associated functionality may represent an additional mode such as an "enhanced mode" into which the SAOC codec of FIG. 1 could be switchable. Examples for the latter possibility will be presented thereinafter.

FIG. 3 shows a decoder 50. The decoder 50 comprises means 52 for computing prediction coefficients and means 54 for upmixing a downmix signal.

The audio decoder 50 of FIG. 3 is dedicated for decoding a multi-audio-object signal having an audio signal of a first type and an audio signal of a second type encoded therein. The audio signal of the first type and the audio signal of the second type may be a mono or stereo audio signal, respectively. The audio signal of the first type is, for example, a background object whereas the audio signal of the second type is a foreground object. That is, the embodiment of FIG. 3 and FIG. 4 is not necessarily restricted to Karaoke/Solo mode applications. Rather, the decoder of FIG. 3 and the encoder of FIG. 4 may be advantageously used elsewhere.

The multi-audio-object signal consists of a downmix signal 56 and side information 58. The side information 58 comprises level information 60 describing, for example, spectral energies of the audio signal of the first type and the audio signal of the second type in a first predetermined time/frequency resolution such as, for example, the time/frequency resolution 42. In particular, the level information 60 may comprise a normalized spectral energy scalar value per object and time/frequency tile. The normalization may be related to the highest spectral energy value among the audio signals of the first and second type at the respective time/frequency tile. The latter possibility results in OLDs for representing the level information, also called level difference information herein. Although the following embodiments use OLDs, they may, although not explicitly stated there, use an otherwise normalized spectral energy representation.

The side information 58 comprises also a residual signal 62 specifying residual level values in a second predetermined time/frequency resolution which may be equal to or different to the first predetermined time/frequency resolution.

The means 52 for computing prediction coefficients is configured to compute prediction coefficients based on the level information 60. Additionally, means 52 may compute the prediction coefficients further based on inter-correlation information also comprised by side information 58. Even further, means 52 may use time varying downmix prescription information comprised by side information 58 to compute the prediction coefficients. The prediction coefficients computed by means 52 are needed for retrieving or upmixing the original audio objects or audio signals from the downmix signal 56.

Accordingly, means 54 for upmixing is configured to upmix the downmix signal 56 based on the prediction coefficients 64 received from means 52 and the residual signal 62. By using the residual 62, decoder 50 is able to better suppress cross talks from the audio signal of one type to the audio signal of the other type. In addition to the residual signal 62, means 54 may use the time varying downmix prescription to upmix the downmix signal. Further, means 54 for upmixing may use user input 66 in order to decide which of the audio signals recovered from the downmix signal 56 to be actually output at output 68 or to what extent. As a first extreme, the user input 66 may instruct means 54 to merely output the first up-mix signal approximating the audio signal of the first type. The opposite is true for the second extreme according to which means 54 is to output merely the second up-mix signal approximating the audio signal of the second type. Intermediate options are possible as well according to which a mixture of both up-mix signals is rendered an output at output 68.

FIG. 4 shows an embodiment for an audio encoder suitable for generating a multi-audio object signal decoded by the decoder of FIG. 3. The encoder of FIG. 4 which is indicated by reference sign 80, may comprise means 82 for spectrally decomposing in case the audio signals 84 to be encoded are not within the spectral domain. Among the audio signals 84, in turn, there is at least one audio signal of a first type and at least one audio signal of a second type. The means 82 for spectrally decomposing is configured to spectrally decompose each of these signals 84 into a representation as shown in FIG. 2, for example. That is, the means 82 for spectrally decomposing spectrally decomposes the audio signals 84 at a predetermined time/frequency resolution. Means 82 may comprise a filter bank, such as a hybrid QMF bank.

The audio encoder 80 further comprises means 86 for computing level information, means 88 for downmixing, means 90 for computing prediction coefficients and means 92 for setting a residual signal. Additionally, audio encoder 80 may comprise means for computing inter-correlation information, namely means 94. Means 86 computes level information describing the level of the audio signal of the first type and the audio signal of the second type in the first predetermined time/frequency resolution from the audio signal as optionally output by means 82. Similarly, means 88 downmixes the audio signals. Means 88 thus outputs the downmix signal 56. Means 86 also outputs the level information 60. Means 90 for computing prediction coefficients acts similarly to means 52. That is, means 90 computes prediction coefficients from the level information 60 and outputs the prediction coefficients 64 to means 92. Means 92, in turn, sets the residual signal 62 based on the downmix signal 56, the predication coefficients 64 and the original audio signals at a second predetermined time/frequency resolution such that up-mixing the downmix signal 56 based on both the prediction coefficients 64 and the residual signal 62 results in a first up-mix audio signal approximating the audio signal of the first type and the second up-mix audio signal approximating the audio signal of the second type, the approximation being approved compared to the absence of the residual signal 62.

The residual signal 62 and the level information 60 are comprised by the side information 58 which forms, along with the downmix signal 56, the multi-audio-object signal to be decoded by decoder FIG. 3.

As shown in FIG. 4, and analogous to the description of FIG. 3, means 90 may additionally use the inter-correlation information output by means 94 and/or time varying downmix prescription output by means 88 to compute the prediction coefficient 64. Further, by means 92 for setting the residual signal 62 may additionally use the time varying downmix prescription output by means 88 in order to appropriately set the residual signal 62.

Again, it is noted that the audio signal of the first type may be a mono or stereo audio signal. The same applies for the audio signal of the second type. The residual signal 62 may be signaled within the side information in the same time/frequency resolution as the parameter time/frequency resolution used to compute, for example, the level information, or a different time/frequency resolution may be used. Further, it may be possible that the signaling of the residual signal is restricted to a sub-portion of the spectral range occupied by the time/frequency tiles 42 for which level information is signaled. For example, the time/frequency resolution at which the residual signal is signaled, may be indicated within the side information 58 by use of syntax elements bsResidualBands and bsResidualFramesPerSAOCFrame. These two syntax elements may define another sub-division of a frame into time/frequency tiles than the sub-division leading to tiles 42.

By the way, it is noted that the residual signal 62 may or may not reflect information loss resulting from a potentially used core encoder 96 optionally used to encode the downmix signal 56 by audio encoder 80. As shown in FIG. 4, means 92 may perform the setting of the residual signal 62 based on the version of the downmix signal re-constructible from the output of core coder 96 or from the version input into core encoder 96'. Similarly, the audio decoder 50 may comprise a core decoder 98 to decode or decompress downmix signal 56.

The ability to set, within the multiple-audio-object signal, the time/frequency resolution used for the residual signal 62 different from the time/frequency resolution used for computing the level information 60 enables to achieve a good compromise between audio quality on the one hand and compression ratio of the multiple-audio-object signal on the other hand. In any case, the residual signal 62 enables to better suppress cross-talk from one audio signal to the other within the first and second up-mix signals to be output at output 68 according to the user input 66.

As will become clear from the following embodiment, more than one residual signal 62 may be transmitted within the side information in case more than one foreground object or audio signal of the second type is encoded. The side information may allow for an individual decision as to whether a residual signal 62 is transmitted for a specific audio signal of a second type or not. Thus, the number of residual signals 62 may vary from one up to the number of audio signals of the second type.

In the audio decoder of FIG. 3, the means 54 for computing may be configured to compute a prediction coefficient matrix C consisting of the prediction coefficients based on the level information (OLD) and means 56 may be configured to yield the first up-mix signal $S_1$ and/or the second up-mix signal $S_2$ from the downmix signal d according to a computation representable by $$\begin{pmatrix} S_1 \\ S_2 \end{pmatrix} = D^{-1}\left\{\begin{pmatrix} 1 \\ C \end{pmatrix} d + H\right\},$$

where the "1" denotes—depending on the number of channels of d—a scalar, or an identity matrix, and $D^{-1}$ is a matrix uniquely determined by a downmix prescription according to which the audio signal of the first type and the audio signal of the second type are downmixed into the downmix signal, and which is also comprised by the side information, and H is a term being independent from d but dependent from the residual signal.

As noted above and described further below, the downmix prescription may vary in time and/or may spectrally vary within the side information. If the audio signal of the first type is a stereo audio signal having a first (L) and a second input channel (R), the level information, for example, describes normalized spectral energies of the first input channel (L), the second input channel (R) and the audio signal of the second type, respectively, at the time/frequency resolution 42.

The aforementioned computation according to which the means 56 for up-mixing performs the up-mixing may even be representable by $$\begin{pmatrix} \hat{L} \\ \hat{R} \\ S_2 \end{pmatrix} = D^{-1}\left\{\begin{pmatrix} 1 \\ C \end{pmatrix} d + H\right\},$$

wherein $\hat{L}$ is a first channel of the first up-mix signal, approximating L and $\hat{R}$ is a second channel of the first up-mix signal, approximating R, and the "1" is a scalar in case d is mono, and a 2×2 identity matrix in case d is stereo. If the downmix signal 56 is a stereo audio signal having a first (L0) and second output channel (R0), and the computation according to which the means 56 for up-mixing performs the up-mixing may be representable by $$\begin{pmatrix} \hat{L} \\ \hat{R} \\ S_2 \end{pmatrix} = D^{-1}\left\{\begin{pmatrix} 1 \\ C \end{pmatrix}\begin{pmatrix} L0 \\ R0 \end{pmatrix} + H\right\}.$$

As far as the term H being dependent on the residual signal res is concerned, the computation according to which the means 56 for up-mixing performs the up-mixing may be representable by $$\begin{pmatrix} S_1 \\ S_2 \end{pmatrix} = D^{-1}\begin{pmatrix} 1 & 0 \\ C & 1 \end{pmatrix}\begin{pmatrix} d \\ res \end{pmatrix}.$$

The multi-audio-object signal may even comprise a plurality of audio signals of the second type and the side information may comprise one residual signal per audio signal of the second type. A residual resolution parameter may be present in the side information defining a spectral range over which the residual signal is transmitted within the side information. It may even define a lower and an upper limit of the spectral range.

Further, the multi-audio-object signal may also comprise spatial rendering information for spatially rendering the audio signal of the first type onto a predetermined loudspeaker configuration. In other words, the audio signal of the first type may be a multi channel (more than two channels) MPEG Surround signal downmixed down to stereo.

In the following, embodiments will be described which make use of the above residual signal signaling. However, it is noted that the term "object" is often used in a double sense. Sometimes, an object denotes an individual mono audio signal. Thus, a stereo object may have a mono audio signal forming one channel of a stereo signal. However, at other situations, a stereo object may denote, in fact, two objects, namely an object concerning the right channel and a further object concerning the left channel of the stereo object. The actual sense will become apparent from the context.

Before describing the next embodiment, same is motivated by deficiencies realized with the baseline technology of the SAOC standard selected as reference model 0 (RM0) in 2007. The RM0 allowed the individual manipulation of a number of sound objects in terms of their panning position and amplification/attenuation. A special scenario has been presented in the context of a "Karaoke" type application. In this case

- a mono, stereo or surround background scene (in the following called Background Object, BGO) is conveyed from a set of certain SAOC objects, which is reproduced without alteration, i.e. every input channel signal is reproduced through the same output channel at an unaltered level, and
- a specific object of interest (in the following called Foreground Object FGO) (typically the lead vocal) which is reproduced with alterations (the FGO is typically positioned in the middle of the sound stage and can be muted, i.e. attenuated heavily to allow sing-along).

As it is visible from subjective evaluation procedures, and could be expected from the underlying technology principle, manipulations of the object position lead to high-quality results, while manipulations of the object level are generally more challenging. Typically, the higher the additional signal amplification/attenuation is, the more potential artefacts arise. In this sense, the Karaoke scenario is extremely demanding since an extreme (ideally: total) attenuation of the FGO is necessitated.

The dual usage case is the ability to reproduce only the FGO without the background/MBO, and is referred to in the following as the solo mode.

Figure 5:
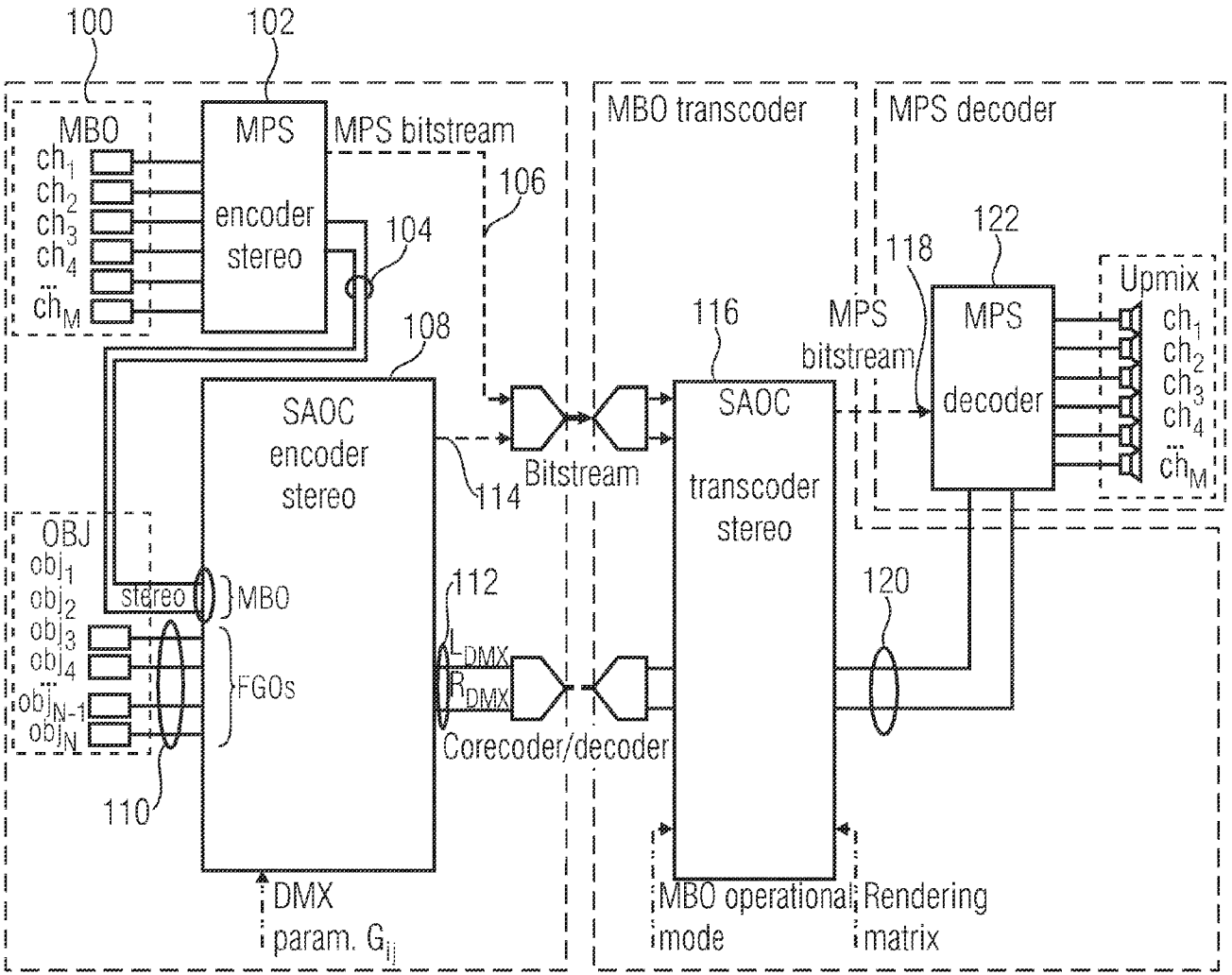
FIG. 5 shows a block diagram of an audio encoder/decoder arrangement for Karaoke/Solo mode application, as a comparison embodiment.

It is noted, however, that if a surround background scene is involved, it is referred to as a Multi-Channel Background Object (MBO). The handling of the MBO is the following, which is shown in FIG. 5:

- The MBO is encoded using a regular 5-2-5 MPEG Surround tree 102. This results in a stereo MBO downmix signal 104, and an MBO MPS side information stream 106.
- The MBO downmix is then encoded by a subsequent SAOC encoder 108 as a stereo object, (i.e. two object level differences, plus an inter-channel correlation), together with the (or several) FGO 110. This results in a common downmix signal 112, and a SAOC side information stream 114.

In the transcoder 116, the downmix signal 112 is preprocessed and the SAOC and MPS side information streams 106, 114 are transcoded into a single MPS output side information stream 118. This currently happens in a discontinuous way, i.e. either only full suppression of the FGO(s) is supported or full suppression of the MBO.

Finally, the resulting downmix 120 and MPS side information 118 are rendered by an MPEG Surround decoder 122.

In FIG. 5, both the MBO downmix 104 and the controllable object signal(s) 110 are combined into a single stereo downmix 112. This "pollution" of the downmix by the controllable object 110 is the reason for the difficulty of recovering a Karaoke version with the controllable object 110 being removed, which is of sufficiently high audio quality. The following proposal aims at circumventing this problem.

Figure 6:
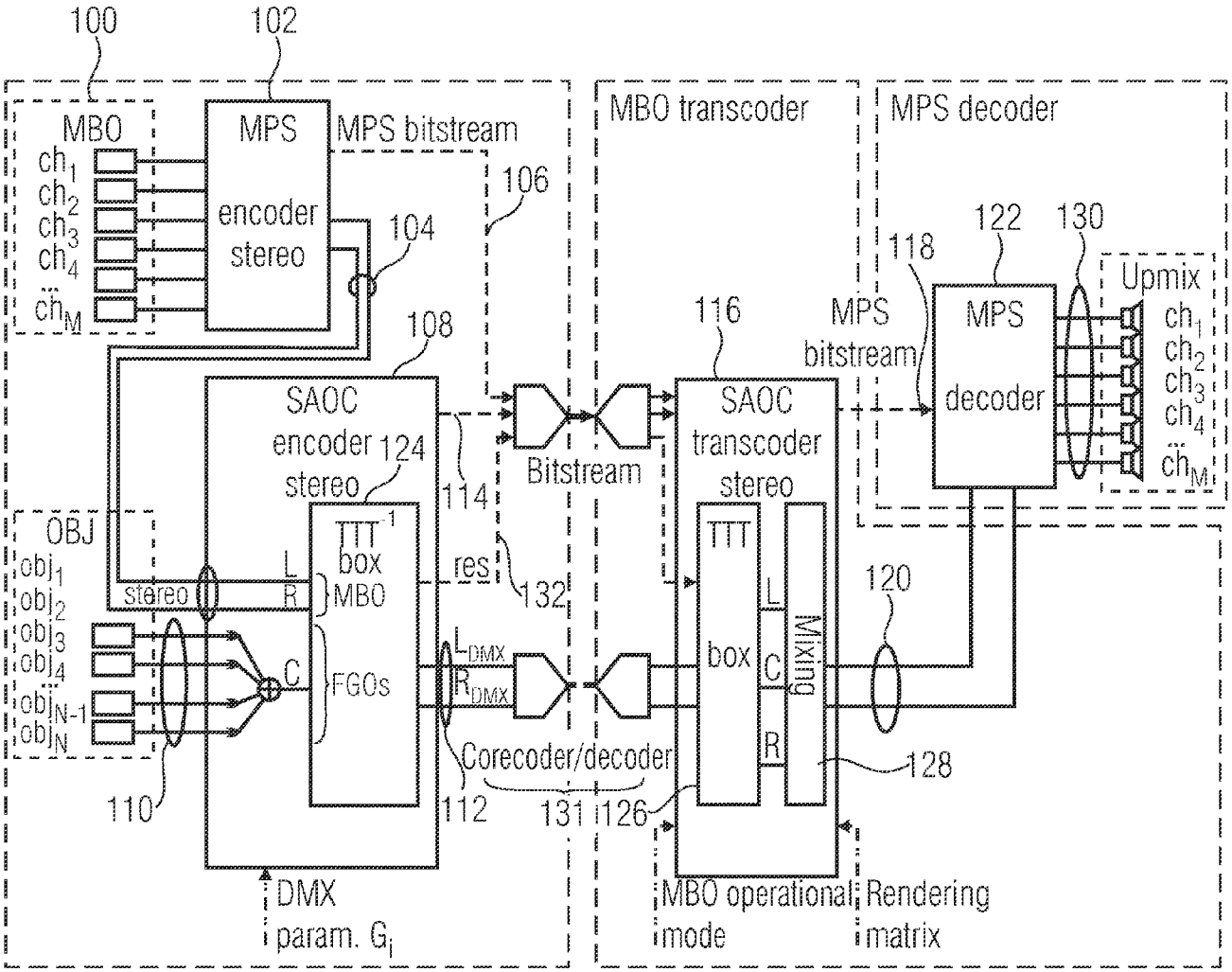
FIG. 6 shows a block diagram of an audio encoder/decoder arrangement for Karaoke/Solo mode application according to an embodiment.

Assuming one FGO (e.g. one lead vocal), the key observation used by the following embodiment of FIG. 6 is that the SAOC downmix signal is a combination of the BGO and the FGO signal, i.e. three audio signals are downmixed and transmitted via 2 downmix channels. Ideally, these signals should be separated again in the transcoder in order to produce a clean Karaoke signal (i.e. to remove the FGO signal), or to produce a clean solo signal (i.e. to remove the BGO signal). This is achieved, in accordance with the embodiment of FIG. 6, by using a "two-to-three" (TTT) encoder element 124 ($TTT^{-1}$ as it is known from the MPEG Surround specification) within SAOC encoder 108 to combine the BGO and the FGO into a single SAOC downmix signal in the SAOC encoder. Here, the FGO feeds the "center" signal input of the $TTT^{-1}$ box 124 while the BGO 104 feeds the "left/right" $TTT^{-1}$ inputs L.R. The transcoder 116 can then produce approximations of the BGO 104 by using a TTT decoder element 126 (TTT as it is known from MPEG Surround), i.e. the "left/right" TTT outputs L,R carry an approximation of the BGO, whereas the "center" TTT output C carries an approximation of the FGO 110.

When comparing the embodiment of FIG. 6 with the embodiment of an encoder and decoder of FIGS. 3 and 4, reference sign 104 corresponds to the audio signal of the first type among audio signals 84, means 82 is comprised by MPS encoder 102, reference sign 110 corresponds to the audio signals of the second type among audio signal 84, $TTT^{-1}$ box 124 assumes the responsibility for the functionalities of means 88 to 92, with the functionalities of means 86 and 94 being implemented in SAOC encoder 108, reference sign 112 corresponds to reference sign 56, reference sign 114 corresponds to side information 58 less the residual signal 62, TTT box 126 assumes responsibility for the functionality of means 52 and 54 with the functionality of the mixing box 128 also being comprised by means 54. Lastly, signal 120 corresponds to the signal output at output 68. Further, it is noted that FIG. 6 also shows a core coder/decoder path 131 for the transport of the down mix 112 from SAOC encoder 108 to SAOC transcoder 116. This core coder/decoder path 131 corresponds to the optional core coder 96 and core decoder 98. As indicated in FIG. 6, this core coder/decoder path 131 may also encode/compress the side information transported signal from encoder 108 to transcoder 116.

The advantages resulting from the introduction of the TTT box of FIG. 6 will become clear by the following description. For example, by

- simply feeding the "left/right" TTT outputs L.R. into the MPS downmix 120 (and passing on the transmitted MBO MPS bitstream 106 in stream 118), only the MBO is reproduced by the final MPS decoder. This corresponds to the Karaoke mode.
- simply feeding the "center" TTT output C. into left and right MPS downmix 120 (and producing a trivial MPS bitstream 118 that renders the FGO 110 to the desired position and level), only the FGO 110 is reproduced by the final MPS decoder 122. This corresponds to the Solo mode.

The handling of the three TTT output signals L.R.C. is performed in the "mixing" box 128 of the SAOC transcoder 116.

The processing structure of FIG. 6 provides a number of distinct advantages over FIG. 5:

- The framework provides a clean structural separation of background (MBO) 100 and FGO signals 110
- The structure of the TTT element 126 attempts a best possible reconstruction of the three signals L.R.C. on a waveform basis. Thus, the final MPS output signals 130 are not only formed by energy weighting (and decorrelation) of the downmix signals, but also are closer in terms of waveforms due to the TTT processing.
- Along with the MPEG Surround TTT box 126 comes the possibility to enhance the reconstruction precision by using residual coding. In this way, a significant enhancement in reconstruction quality can be achieved as the residual bandwidth and residual bitrate for the residual signal 132 output by $TTT^{-1}$ 124 and used by TTT box for upmixing are increased. Ideally (i.e. for infinitely fine quantization in the residual coding and the coding of the downmix signal), the interference between the background (MBO) and the FGO signal is cancelled.

The processing structure of FIG. 6 possesses a number of characteristics:

- Duality Karaoke/Solo mode: The approach of FIG. 6 offers both Karaoke and Solo functionality by using the same technical means. That is, SAOC parameters are reused, for example.
- Refineability: The quality of the Karaoke/Solo signal can be refined as needed by controlling the amount of residual coding information used in the TTT boxes. For example, parameters bsResidualSamplingFrequency-Index, bsResidualBands and bsResidualFramesPerS-AOCFrame may be used.
- Positioning of FGO in downmix: When using a TTT box as specified in the MPEG Surround specification, the FGO would be mixed into the center position between the left and right downmix channels. In order to allow more flexibility in positioning, a generalized TTT encoder box is employed which follows the same principles while allowing non-symmetric positioning of the signal associated to the "center" inputs/outputs.
- Multiple FGOs: In the configuration described, the use of only one FGO was described (this may correspond to the most important application case). However, the proposed concept is also able to accommodate several FGOs by using one or a combination of the following measures:
  - Grouped FGOs: Like shown in FIG. 6, the signal that is connected to the center input/output of the TTT box can actually be the sum of several FGO signals rather than only a single one. These FGOs can be independently positioned/controlled in the multi-channel output signal 130 (maximum quality advantage is achieved, however, when they are scaled & positioned in the same way). They share a common position in the stereo downmix signal 112, and there is only one residual signal 132. In any case, the interference between the background (MBO) and the controllable objects is cancelled (although not between the controllable objects).
  - Cascaded FGOs: The restrictions regarding the common FGO position in the downmix 112 can be overcome by extending the approach of FIG. 6. Multiple FGOs can be accommodated by cascading several stages of the described TTT structure, each stage corresponding to one FGO and producing a residual coding stream. In this way, interference ideally would be cancelled also between each FGO. Of course, this option necessitates a higher bitrate than using a grouped FGO approach. An example will be described later.
- SAOC side information: In MPEG Surround, the side information associated to a TTT box is a pair of Channel Prediction Coefficients (CPCs). In contrast, the SAOC parametrization and the MBO/Karaoke scenario transmit object energies for each object signal, and an inter-signal correlation between the two channels of the MBO downmix (i.e. the parametrization for a "stereo object"). In order to minimize the number of changes in the parametrization relative to the case without the enhanced Karaoke/Solo mode, and thus bitstream format, the CPCs can be calculated from the energies of the downmixed signals (MBO downmix and FGOs) and the inter-signal correlation of the MBO downmix stereo object. Therefore, there is no need to change or augment the transmitted parametrization and the CPCs can be calculated from the transmitted SAOC parametrization in the SAOC transcoder 116. In this way, a bitstream using the Enhanced Karaoke/Solo mode could also be decoded by a regular mode decoder (without residual coding) when ignoring the residual data.

In summary, the embodiment of FIG. 6 aims at an enhanced reproduction of certain selected objects (or the scene without those objects) and extends the current SAOC encoding approach using a stereo downmix in the following way:

In the normal mode, each object signal is weighted by its entries in the downmix matrix (for its contribution to the left and to the right downmix channel, respectively). Then, all weighted contributions to the left and right downmix channel are summed to form the left and right downmix channels.

For enhanced Karaoke/Solo performance, i.e. in the enhanced mode, all object contributions are partitioned into a set of object contributions that form a Foreground Object (FGO) and the remaining object contributions (BGO). The FGO contribution is summed into a mono downmix signal, the remaining background contributions are summed into a stereo downmix, and both are summed using a generalized TTT encoder element to form the common SAOC stereo downmix.

Thus, a regular summation is replaced by a "TTT summation" (which can be cascaded when desired).

Figure 7B:
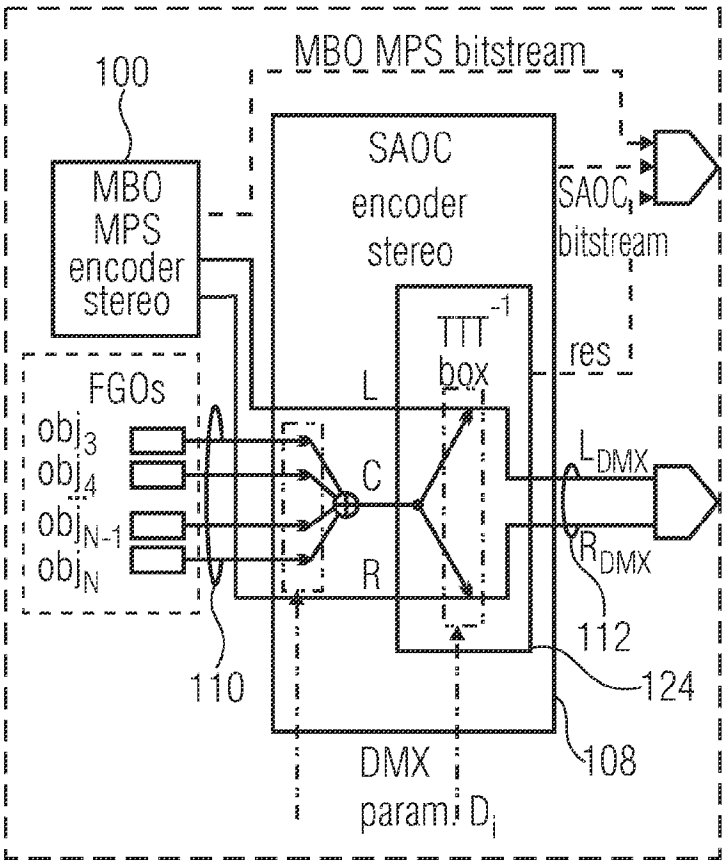
FIG. 7*b* shows a block diagram of an audio encoder for a Karaoke/Solo mode application, according to an embodiment.
Figure 7A:
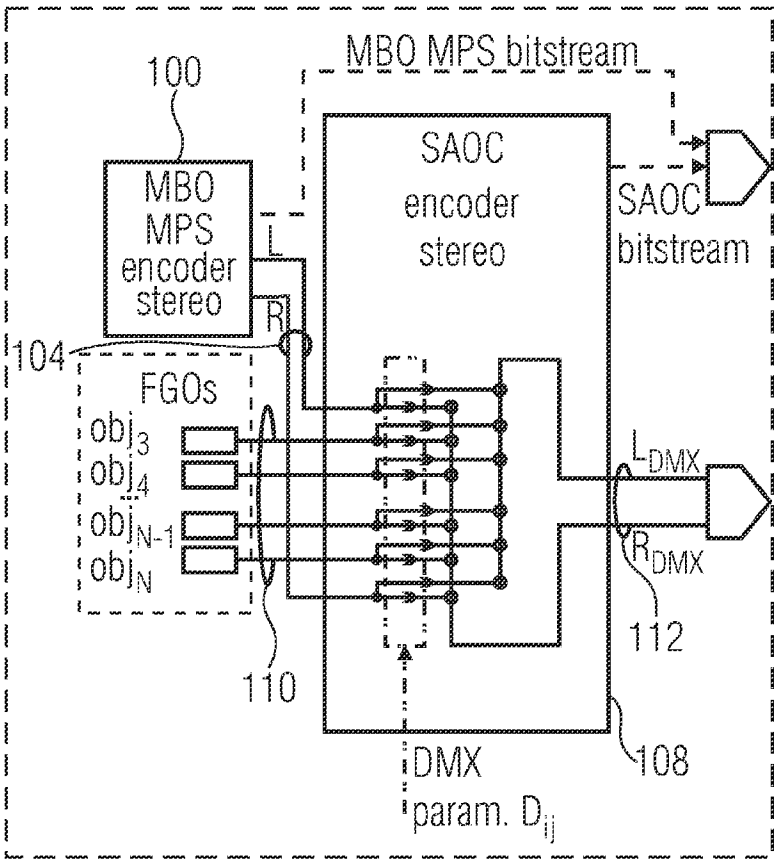
FIG. 7*a* shows a block diagram of an audio encoder for a Karaoke/Solo mode application, according to a comparison embodiment.

In order to emphasize the just-mentioned difference between the normal mode of the SAOC encoder and the enhanced mode, reference is made to FIGS. 7*a* and 7*b*, where FIG. 7*a* concerns the normal mode, whereas FIG. 7*b* concerns the enhanced mode. As can be seen, in the normal mode, the SAOC encoder 108 uses the afore-mentioned DMX parameters $D_{ij}$ for weighting objects j and adding the thus weighed object j to SAOC channel i, i.e. L0 or R0. In case of the enhanced mode of FIG. 6, merely a vector of DMX-parameters $D_i$ is needed, namely, DMX-parameters $D_i$ indicating how to form a weighted sum of the FGOs 110, thereby obtaining the center channel C for the $TTT^{-1}$ box 124, and DMX-parameters $D_i$, instructing the $TTT^{-1}$ box how to distribute the center signal C to the left MBO channel and the right MBO channel respectively, thereby obtaining the $L_{DMX}$ or $R_{DMX}$ respectively.

Problematically, the processing according to FIG. 6 does not work very well with non-waveform preserving codecs (HE-AAC/SBR). A solution for that problem may be an energy-based generalized TTT mode for HE-AAC and high frequencies. An embodiment addressing the problem will be described later.

A possible bitstream format for the one with cascaded TTTs could be as follows:

An addition to the SAOC bitstream that needs to be able to be skipped if to be digested in "regular decode mode":

```
numTTTs int
for (ttt=0; ttt<numTTTs; ttt++)
{no_TTT_obj[ttt] int
   TTT_bandwidth[ttt];
   TTT_residual_stream[ttt]
}
```

As to complexity and memory requirements, the following can be stated. As can be seen from the previous explanations, the enhanced Karaoke/Solo mode of FIG. 6 is implemented by adding stages of one conceptual element in the encoder and decoder/transcoder each, i.e. the generalized TTT-1/TTT encoder element. Both elements are identical in their complexity to the regular "centered" TTT counterparts (the change in coefficient values does not influence complexity). For the envisaged main application (one FGO as lead vocals), a single TTT is sufficient.

The relation of this additional structure to the complexity of an MPEG Surround system can be appreciated by looking at the structure of an entire MPEG Surround decoder which for the relevant stereo downmix case (5-2-5 configuration) consists of one TTT element and 2 OTT elements. This already shows that the added functionality comes at a moderate price in terms of computational complexity and memory consumption (note that conceptual elements using residual coding are on average no more complex than their counterparts which include decorrelators instead).

This extension of FIG. 6 of the MPEG SAOC reference model provides an audio quality improvement for special solo or mute/Karaoke type of applications. Again it is noted, that the description corresponding to FIGS. 5, 6 and 7 refer to a MBO as background scene or BGO, which in general is not limited to this type of object and can rather be a mono or stereo object, too.

A subjective evaluation procedure reveals the improvement in terms of audio quality of the output signal for a Karaoke or solo application. The conditions evaluated are:

RM0

Enhanced mode (res 0) (=without residual coding)

Enhanced mode (res 6) (=with residual coding in the lowest 6 hybrid QMF bands)

Enhanced mode (res 12) (=with residual coding in the lowest 12 hybrid QMF bands)

Enhanced mode (res 24) (=with residual coding in the lowest 24 hybrid QMF bands)

Hidden Reference

Lower anchor (3.5 kHz band limited version of reference)

The bitrate for the proposed enhanced mode is similar to RM0 if used without residual coding. All other enhanced modes necessitate about 10 kbit/s for every 6 bands of residual coding.

Figure 8A:
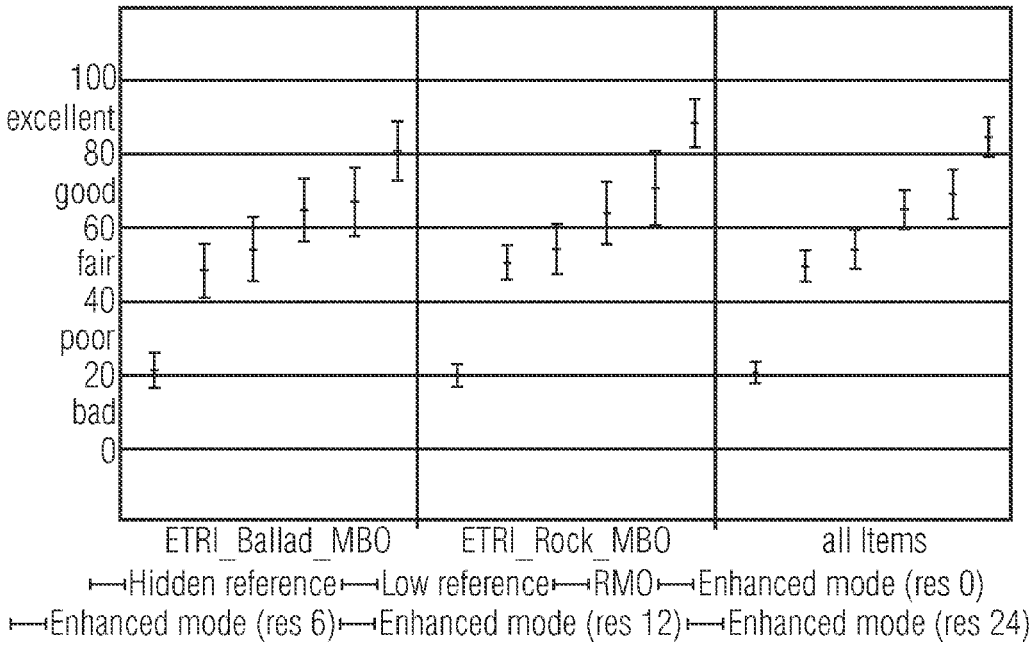
FIGS. 8*a* and *b* show plots of quality measurement results.

FIG. 8*a* shows the results for the mute/Karaoke test with 10 listening subjects. The proposed solution has an average MUSHRA score which is higher than RM0 and increases with each step of additional residual coding. A statistically significant improvement over the performance of RM0 can be clearly observed for modes with 6 and more bands of residual coding.

Figure 8B:
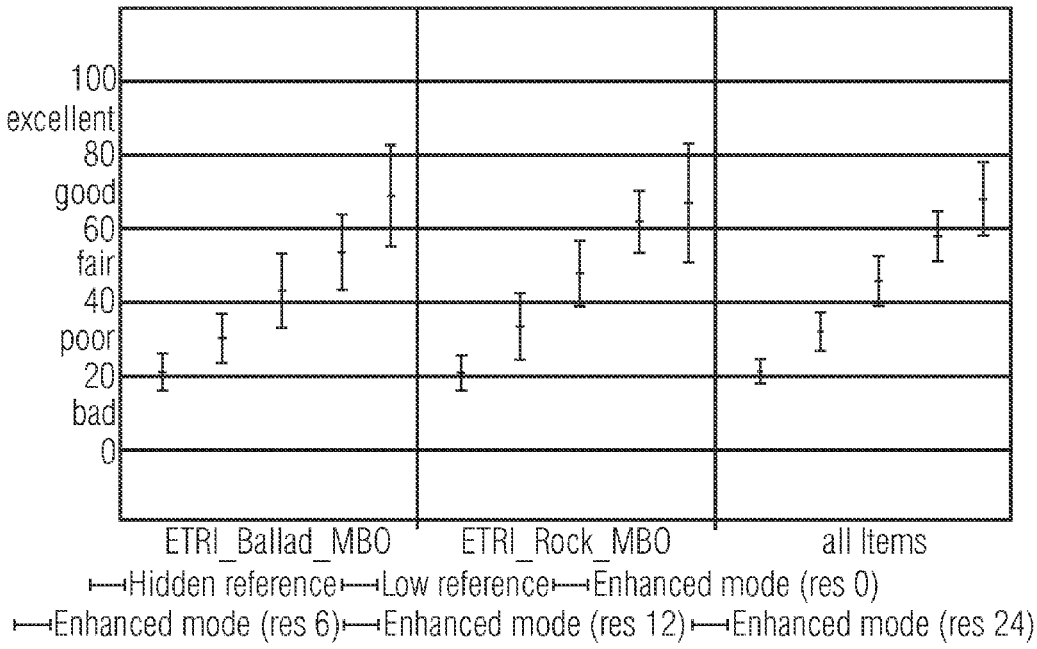

The results for the solo test with 9 subjects in FIG. 8*b* show similar advantages for the proposed solution. The average MUSHRA score is clearly increased when adding more and more residual coding. The gain between enhanced mode without and enhanced mode with 24 bands of residual coding is almost 50 MUSHRA points.

Overall, for a Karaoke application good quality is achieved at the cost of a ca. 10 kbit/s higher bitrate than RM0. Excellent quality is possible when adding ca. 40 kbit/s on top of the bitrate of RM0. In a realistic application scenario where a maximum fixed bitrate is given, the proposed enhanced mode nicely allows to spend "unused bitrate" for residual coding until the permissible maximum rate is reached. Therefore, the best possible overall audio quality is achieved. A further improvement over the presented experimental results is possible due to a more intelligent usage of residual bitrate: While the presented setup was using residual coding from DC to a certain upper border frequency, an enhanced implementation would spend only bits for the frequency range that is relevant for separating FGO and background objects.

In the foregoing description, an enhancement of the SAOC technology for the Karaoke-type applications has been described. Additional detailed embodiments of an application of the enhanced Karaoke/solo mode for multi-channel FGO audio scene processing for MPEG SAOC are presented.

Figure 9:
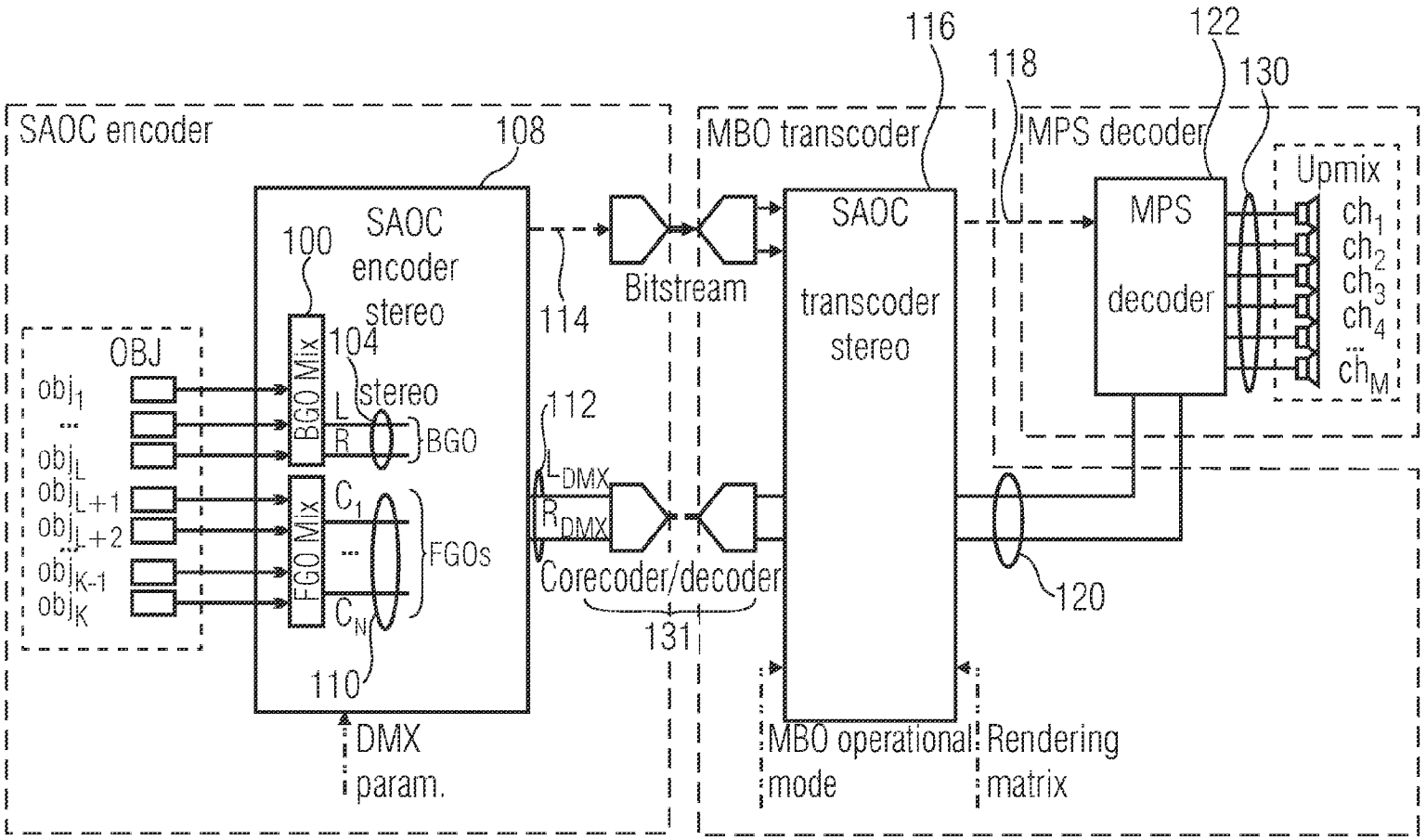
FIG. 9 shows a block diagram of an audio encoder/decoder arrangement for Karaoke/Solo mode application, for comparison purposes.

In contrast to the FGOs, which are reproduced with alterations, the MBO signals have to be reproduced without alteration, i.e. every input channel signal is reproduced through the same output channel at an unchanged level. Consequently, the preprocessing of the MBO signals by an MPEG Surround encoder had been proposed yielding a stereo downmix signal that serves as a (stereo) background object (BGO) to be input to the subsequent Karaoke/solo mode processing stages comprising an SAOC encoder, an MBO transcoder and an MPS decoder. FIG. 9 shows a diagram of the overall structure, again.

As can be seen, according to the Karaoke/solo mode coder structure, the input objects are classified into a stereo background object (BGO) 104 and foreground objects (FGO) 110.

While in RM0 the handling of these application scenarios is performed by an SAOC encoder/transcoder system, the enhancement of FIG. 6 additionally exploits an elementary building block of the MPEG Surround structure. Incorporating the three-to-two ($TTT^{-1}$) block at the encoder and the corresponding two-to-three (TTT) complement at the transcoder improves the performance when strong boost/attenuation of the particular audio object is necessitated. The two primary characteristics of the extended structure are:

- better signal separation due to exploitation of the residual signal (compared to RM0),
- flexible positioning of the signal that is denoted as the center input (i.e. the FGO) of the $TTT^{-1}$ box by generalizing its mixing specification.

Figure 10:
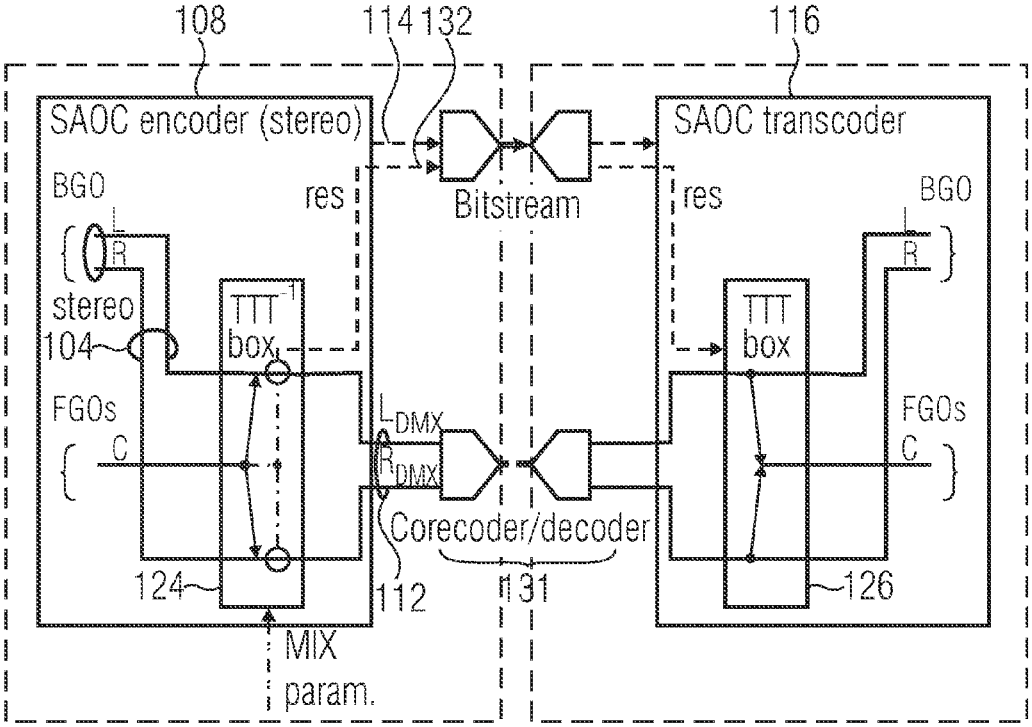
FIG. 10 shows a block diagram of an audio encoder/decoder arrangement for Karaoke/Solo mode application according to an embodiment.

Since the straightforward implementation of the TTT building block involves three input signals at encoder side, FIG. 6 was focused on the processing of FGOs as a (downmixed) mono signal as depicted in FIG. 10. The treatment of multi-channel FGO signals has been stated, too, but will be explained in more detail in the subsequent chapter.

As can be seen from FIG. 10, in the enhanced mode of FIG. 6, a combination of all FGOs is fed into the center channel of the $TTT^{-1}$ box.

In case of an FGO mono downmix as is the case with FIG. 6 and FIG. 10, the configuration of the $TTT^{-1}$ box at the encoder comprises the FGO that is fed to the center input and the BGO providing the left and right input. The underlying symmetric matrix is given by:

$$D = \begin{pmatrix} 1 & 0 & m_1 \\ 0 & 1 & m_2 \\ m_1 & m_2 & -1 \end{pmatrix},$$

which provides the downmix $(L0\ R0)^T$ and a signal F0:

$$\begin{pmatrix} L0 \\ R0 \\ F0 \end{pmatrix} = D \begin{pmatrix} L \\ R \\ F \end{pmatrix}.$$

The $3^{rd}$ signal obtained through this linear system is discarded, but can be reconstructed at transcoder side incorporating two prediction coefficients $c_1$ and $c_2$ (CPC) according to:

$$\hat{F}0 = c_1 L0 + c_2 R0.$$

The inverse process at the transcoder is given by:

$$D^{-1}C = \frac{1}{1+m_1^2+m_2^2}\begin{pmatrix} 1+m_2^2+\alpha m_1 & -m_1 m_2+\beta m_1 \\ -m_1 m_2+\alpha m_2 & 1+m_1^2+\beta m_2 \\ m_1 - c_1 & m_2 - c_2 \end{pmatrix}.$$

The parameters $m_1$ and $m_2$ correspond to:

$$m_1 = \cos(\mu)$$

and $$m_2 = \sin(\mu)$$

and $\mu$ is responsible for panning the FGO in the common TTT downmix $(L0\ R0)^T$. The prediction coefficients $c_1$ and $c_2$ necessitated by the TTT upmix unit at transcoder side can be estimated using the transmitted SAOC parameters, i.e. the object level differences (OLDs) for all input audio objects and inter-object correlation (IOC) for BGO downmix (MBO) signals. Assuming statistical independence of FGO and BGO signals the following relationship holds for the CPC estimation:

$$c_1 = \frac{P_{LoFo}P_{Ro} - P_{RoFo}P_{LoRo}}{P_{Lo}P_{Ro} - P_{LoRo}^2},\ c_2 = \frac{P_{RoFo}P_{Lo} - P_{LoFo}P_{LoRo}}{P_{Lo}P_{Ro} - P_{LoRo}^2}.$$

The variables $P_{Lo}$, $P_{Ro}$, $P_{LoRo}$, $P_{LoFo}$ and $P_{RoFo}$ can be estimated as follows, where the parameters $OLD_L$, $OLD_R$ and $IOC_{LR}$ correspond to the BGO, and $OLD_F$ is an FGO parameter:

$$P_{Lo} = OLD_L + m_1^2 OLD_F,$$

$$P_{Ro} = OLD_R + m_2^2 OLD_F,$$

$$P_{LoRo} = IOC_{LR} + m_1 m_2 OLD_F,$$

$$P_{LoFo} = m_1(OLD_L - OLD_F) + m_2 IOC_{LR},$$

$$P_{RoFo} = m_2(OLD_R - OLD_F) + m_1 IOC_{LR}.$$

Additionally, the error introduced by the implication of the CPCs is represented by the residual signal 132 that can be transmitted within the bitstream, such that:

$$res = F0 - \hat{F}0.$$

In some application scenarios the restriction of a single mono downmix of all FGOs is inappropriate, hence needs to be overcome. For example, the FGOs can be divided into two or more independent groups with different positions in the transmitted stereo downmix and/or individual attenuation. Therefore, the cascaded structure shown in FIG. 11 implies two or more consecutive $TTT^{-1}$ elements 124*a*, 124*b*, yielding a step-by-step downmixing of all FGO groups $F_1$, $F_2$ at encoder side until the desired stereo downmix 112 is obtained. Each—or at least some—of the $TTT^{-1}$ boxes 124*a,b* (in FIG. 11 each) sets a residual signal 132*a*, 132*b* corresponding to the respective stage or $TTT^{-1}$ box 124*a,b* respectively. Conversely, the transcoder performs sequential upmixing by use of respective sequentially applied TTT boxes 126*a,b*, incorporating the corresponding CPCs and residual signals, where available. The order of the FGO processing is encoder-specified and must be considered at transcoder side.

Figure 11:
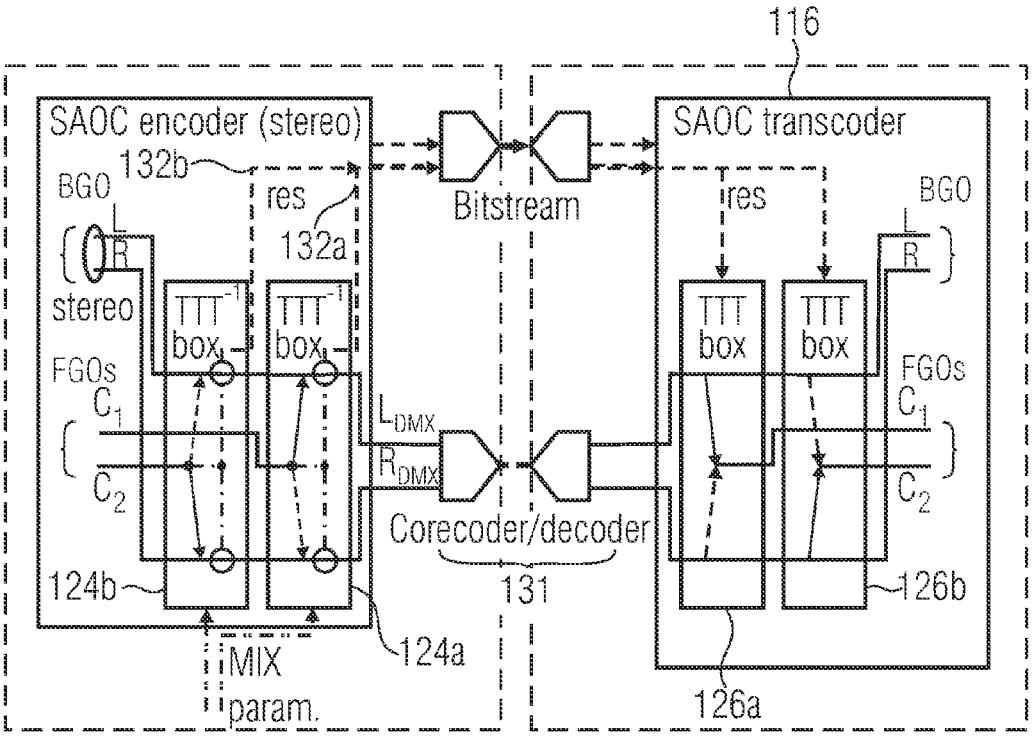
FIG. 11 shows a block diagram of an audio encoder/decoder arrangement for Karaoke/Solo mode application according to a further embodiment.

The detailed mathematics involved with the two-stage cascade shown in FIG. 11 is described in the following.

Without loss in generality, but for a simplified illustration the following explanation is based on a cascade consisting of two TTT elements as shown in FIG. 11. The two symmetric matrices are similar to the FGO mono downmix, but have to be applied adequately to the respective signals:

$$D_1 = \begin{pmatrix} 1 & 0 & m_{11} \\ 0 & 1 & m_{21} \\ m_{11} & m_{21} & -1 \end{pmatrix} \text{ and } D_2 = \begin{pmatrix} 1 & 0 & m_{12} \\ 0 & 1 & m_{22} \\ m_{12} & m_{22} & -1 \end{pmatrix}.$$

Here, the two sets of CPCs result in the following signal reconstruction:

$$\hat{F}0_1 = c_{11}L0_1 + c_{12}R0_1$$

and $$\hat{F}0_2 = c_{21}L0_2 + c_{22}R0_2.$$

The inverse process is represented by:

$$D_1^{-1} = \frac{1}{1 + m_{11}^2 + m_{21}^2}\begin{pmatrix} 1 + m_{21}^2 + c_{11}m_{11} & -m_{11}m_{21} + c_{12}m_{11} \\ -m_{11}m_{21} + c_{11}m_{21} & 1 + m_{11}^2 + c_{12}m_{21} \\ m_{11} - c_{11} & m_{21} - c_{12} \end{pmatrix},$$

and $$D_2^{-1} = \frac{1}{1 + m_{12}^2 + m_{22}^2}\begin{pmatrix} 1 + m_{22}^2 + c_{21}m_{12} & -m_{12}m_{22} + c_{22}m_{12} \\ -m_{12}m_{22} + c_{21}m_{22} & 1 + m_{12}^2 + c_{22}m_{22} \\ m_{12} - c_{21} & m_{22} - c_{22} \end{pmatrix}.$$

A special case of the two-stage cascade comprises one stereo FGO with its left and right channel being summed properly to the corresponding channels of the BGO, yielding $\mu_1=0$ and $$\mu_2 = \frac{\pi}{2}:$$

$$D_L = \begin{pmatrix} 1 & 0 & 1 \\ 0 & 1 & 0 \\ 1 & 0 & -1 \end{pmatrix}, \text{ and } D_R = \begin{pmatrix} 1 & 0 & 0 \\ 0 & 1 & 1 \\ 0 & 1 & -1 \end{pmatrix}.$$

For this particular panning style and by neglecting the inter-object correlation, $OLD_{LR}=0$ the estimation of two sets of CPCs reduce to:

$$c_{L1} = \frac{OLD_L - OLD_{FL}}{OLD_L + OLD_{FL}},\ c_{L2} = 0,$$

$$c_{R1} = 0,\ c_{R2} = \frac{OLD_R - OLD_{FR}}{OLD_R + OLD_{FR}},$$

with $OLD_{FL}$ and $OLD_{FR}$ denoting the OLDs of the left and right FGO signal, respectively.

The general N-stage cascade case refers to a multi-channel FGO downmix according to:

$$D_1 = \begin{pmatrix} 1 & 0 & m_{11} \\ 0 & 1 & m_{21} \\ m_{11} & m_{21} & -1 \end{pmatrix}, D_2 = \begin{pmatrix} 1 & 0 & m_{12} \\ 0 & 1 & m_{22} \\ m_{12} & m_{22} & -1 \end{pmatrix}, \ldots,$$

$$D_N = \begin{pmatrix} 1 & 0 & m_{1N} \\ 0 & 1 & m_{2N} \\ m_{1N} & m_{2N} & -1 \end{pmatrix}.$$

where each stage features its own CPCs and residual signal.

At the transcoder side, the inverse cascading steps are given by:

$$D_1^{-1} = \frac{1}{1 + m_{11}^2 + m_{21}^2}\begin{pmatrix} 1 + m_{21}^2 + c_{11}m_{11} & -m_{11}m_{21} + c_{12}m_{11} \\ -m_{11}m_{21} + c_{11}m_{21} & 1 + m_{11}^2 + c_{12}m_{21} \\ m_{11} - c_{11} & m_{21} - c_{12} \end{pmatrix}, \ldots,$$

$$D_N^{-1} = \frac{1}{1 + m_{1N}^2 + m_{2N}^2}\begin{pmatrix} 1 + m_{2N}^2 + c_{N1}m_{1N} & -m_{1N}m_{2N} + c_{N2}m_{1N} \\ -m_{1N}m_{2N} + c_{N1}m_{2N} & 1 + m_{1N}^2 + c_{N2}m_{2N} \\ m_{1N} - c_{N1} & m_{2N} - c_{N2} \end{pmatrix}.$$

To abolish the necessity of preserving the order of the TTT elements, the cascaded structure can easily be converted into an equivalent parallel by rearranging the N matrices into one single symmetric TTN matrix, thus yielding a general TTN style:

$$D_N = \begin{pmatrix} 1 & 0 & m_{11} & \ldots & m_{1N} \\ 0 & 1 & m_{21} & \ldots & m_{2N} \\ m_{11} & m_{21} & -1 & \ldots & 0 \\ \ldots & \ldots & \ldots & \ddots & \vdots \\ m_{1N} & m_{2N} & 0 & \ldots & -1 \end{pmatrix},$$

where the first two lines of the matrix denote the stereo downmix to be transmitted. On the other hand, the term TTN—two-to-N—refers to the upmixing process at transcoder side.

Using this description the special case of the particularly panned stereo FGO reduces the matrix to:

$$D = \begin{pmatrix} 1 & 0 & 1 & 0 \\ 0 & 1 & 0 & 1 \\ 1 & 0 & -1 & 0 \\ 0 & 1 & 0 & -1 \end{pmatrix}.$$

Accordingly this unit can be termed two-to-four element or TTF.

It is also possible to yield a TTF structure reusing the SAOC stereo preprocessor module.

For the limitation of N=4 an implementation of the two-to-four (TTF) structure which reuses parts of the existing SAOC system becomes feasible. The processing is described in the following paragraphs.

The SAOC standard text describes the stereo downmix preprocessing for the "stereo-to-stereo transcoding mode". Precisely the output stereo signal Y is calculated from the input stereo signal X together with a decorrelated signal $X_d$ as follows:

$$Y = G_{mod}X + P_2X_d$$

Figure 12:
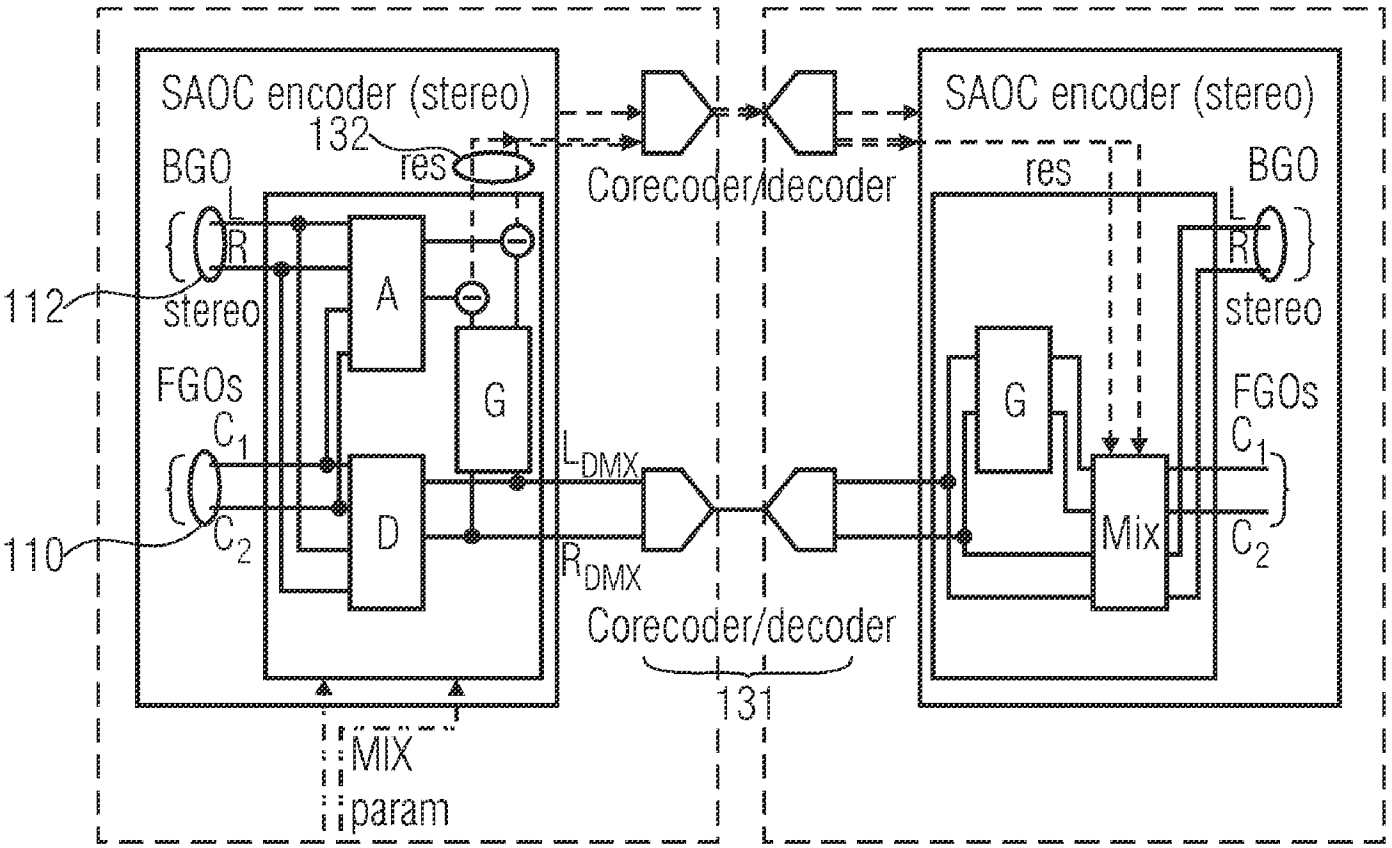
FIG. 12 shows a block diagram of an audio encoder/decoder arrangement for Karaoke/Solo mode application according to a further embodiment.

The decorrelated component $X_d$ is a synthetic representation of parts of the original rendered signal which have already been discarded in the encoding process. According to FIG. 12, the decorrelated signal is replaced with a suitable encoder generated residual signal 132 for a certain frequency range.

The nomenclature is defined as:

D is a 2×N downmix matrix

A is a 2×N rendering matrix

E is a model of the N×N covariance of the input objects S $G_{mod}$ (corresponding to G in FIG. 12) is the predictive 2×2 upmix matrix Note that $G_{mod}$ is a function of D, A and E.

To calculate the residual signal $X_{Res}$ the decoder processing may be mimicked in the encoder, i.e. to determine $G_{mod}$. In general scenarios A is not known, but in the special case of a Karaoke scenario (e.g. with one stereo background and one stereo foreground object, N=4) it is assumed that $$A = \begin{pmatrix} 0 & 0 & 1 & 0 \\ 0 & 0 & 0 & 1 \end{pmatrix}$$

which means that only the BGO is rendered.

For an estimation of the foreground object the reconstructed background object is subtracted from the downmix signal X. This and the final rendering is performed in the "Mix" processing block. Details are presented in the following.

The rendering matrix A is set to $$A_{BGO} = \begin{pmatrix} 0 & 0 & 1 & 0 \\ 0 & 0 & 0 & 1 \end{pmatrix}$$

where it is assumed that the first 2 columns represent the 2 channels of the FGO and the second 2 columns represent the 2 channels of the BGO.

The BGO and FGO stereo output is calculated according to the following formulas.

$$Y_{BGO}=G_{Mod}X+X_{Res}$$

As the downmix weight matrix D is defined as $$D = (D_{FGO} \mid D_{BGO})$$

with $$D_{BGO} = \begin{pmatrix} d_{11} & d_{12} \\ d_{21} & d_{22} \end{pmatrix}$$

and $$Y_{BGO} = \begin{pmatrix} y^l_{BGO} \\ y^r_{BGO} \end{pmatrix}$$

the FGO object can be set to $$Y_{FGO} = D^{-1}_{BGO} \cdot \left[ X - \begin{pmatrix} d_{11} \cdot y^l_{BGO} + d_{12} \cdot y^r_{BGO} \\ d_{21} \cdot y^l_{BGO} + d_{22} \cdot y^r_{BGO} \end{pmatrix} \right]$$

As an example, this reduces to $$Y_{FGO}=X-Y_{BGO}$$

for a downmix matrix of $$D = \begin{pmatrix} 1 & 0 & 1 & 0 \\ 0 & 1 & 0 & 1 \end{pmatrix}$$

$X_{Res}$ are the residual signals obtained as described above. Please note that no decorrelated signals are added.

The final output Y is given by $$Y = A \cdot \begin{pmatrix} Y_{FGO} \\ Y_{BGO} \end{pmatrix}$$

The above embodiments can also be applied if a mono FGO instead of a stereo FGO is used. The processing is then altered according to the following.

The rendering matrix A is set to $$A_{FGO} = \begin{pmatrix} 1 & 0 & 0 \\ 0 & 0 & 0 \end{pmatrix}$$

where it is assumed that the first column represents the mono FGO and the subsequent columns represent the 2 channels of the BGO.

The BGO and FGO stereo output is calculated according to the following formulas.

$$Y_{FGO}=G_{Mod}X+X_{Res}$$

As the downmix weight matrix D is defined as $$D = (D_{FGO} \mid D_{BGO})$$

with $$D_{FGO} = \begin{pmatrix} d^l_{FGO} \\ d^r_{FGO} \end{pmatrix}$$

and $$Y_{FGO} = \begin{pmatrix} y_{FGO} \\ 0 \end{pmatrix}$$

the BGO object can be set to $$Y_{BGO} = D^{-1}_{BGO} \cdot \left[ X - \begin{pmatrix} d^l_{FGO} \cdot y_{FGO} \\ d^r_{FGO} \cdot y_{FGO} \end{pmatrix} \right]$$

As an example, this reduces to $$Y_{BGO} = X - \begin{pmatrix} y_{FGO} \\ y_{FGO} \end{pmatrix}$$

for a downmix matrix of $$D = \begin{pmatrix} 1 & 1 & 0 \\ 1 & 0 & 1 \end{pmatrix}$$

$X_{Res}$ are the residual signals obtained as described above. Please note that no decorrelated signals are added.

The final output Y is given by $$Y = A \cdot \begin{pmatrix} Y_{FGO} \\ Y_{BGO} \end{pmatrix}$$

For the handling of more than 4 FGO objects, the above embodiments can be extended by assembling parallel stages of the processing steps just described.

The above just-described embodiments provided the detailed description of the enhanced Karaoke/solo mode for the cases of multi-channel FGO audio scene. This generalization aims to enlarge the class of Karaoke application scenarios, for which the sound quality of the MPEG SAOC reference model can be further improved by application of the enhanced Karaoke/solo mode. The improvement is achieved by introducing a general NTT structure into the downmix part of the SAOC encoder and the corresponding counterparts into the SAOCtoMPS transcoder. The use of residual signals enhanced the quality result.

FIGS. 13*a* to 13*h* show a possible syntax of the SAOC side information bit stream according to an embodiment of the present invention.

After having described some embodiments concerning an enhanced mode for the SAOC codec, it should be noted that some of the embodiments concern application scenarios where the audio input to the SAOC encoder contains not only regular mono or stereo sound sources but multi-channel objects. This was explicitly described with respect to FIGS. 5 to 7*b*. Such multi-channel background object MBO can be considered as a complex sound scene involving a large and often unknown number of sound sources, for which no controllable rendering functionality is necessitated. Individually, these audio sources cannot be handled efficiently by the SAOC encoder/decoder architecture. The concept of the SAOC architecture may, therefore, be thought of being extended in order to deal with these complex input signals, i.e., MBO channels, together with the typical SAOC audio objects. Therefore, in the just-mentioned embodiments of FIGS. 5 to 7*b*, the MPEG Surround encoder is thought of being incorporated into the SAOC encoder as indicated by the dotted line surrounding SAOC encoder 108 and MPS encoder 100. The resulting downmix 104 serves as a stereo input object to the SAOC encoder 108 together with a controllable SAOC object 110 producing a combined stereo downmix 112 transmitted to the transcoder side. In the parameter domain, both the MPS bit stream 106 and the SAOC bit stream 114 are fed into the SAOC transcoder 116 which, depending on the particular MBO applications scenario, provides the appropriate MPS bit stream 118 for the MPEG Surround decoder 122. This task is performed using the rendering information or rendering matrix and employing some downmix pre-processing in order to transform the downmix signal 112 into a downmix signal 120 for the MPS decoder 122.

A further embodiment for an enhanced Karaoke/Solo mode is described below. It allows the individual manipulation of a number of audio objects in terms of their level amplification/attenuation without significant decrease in the resulting sound quality. A special "Karaoke-type" application scenario necessitates a total suppression of the specific objects, typically the lead vocal, (in the following called ForeGround Object FGO) keeping the perceptual quality of the background sound scene unharmed. It also entails the ability to reproduce the specific FGO signals individually without the static background audio scene (in the following called BackGround Object BGO), which does not necessitate user controllability in terms of panning. This scenario is referred to as a "Solo" mode. A typical application case contains a stereo BGO and up to four FGO signals, which can, for example, represent two independent stereo objects.

Figure 14:
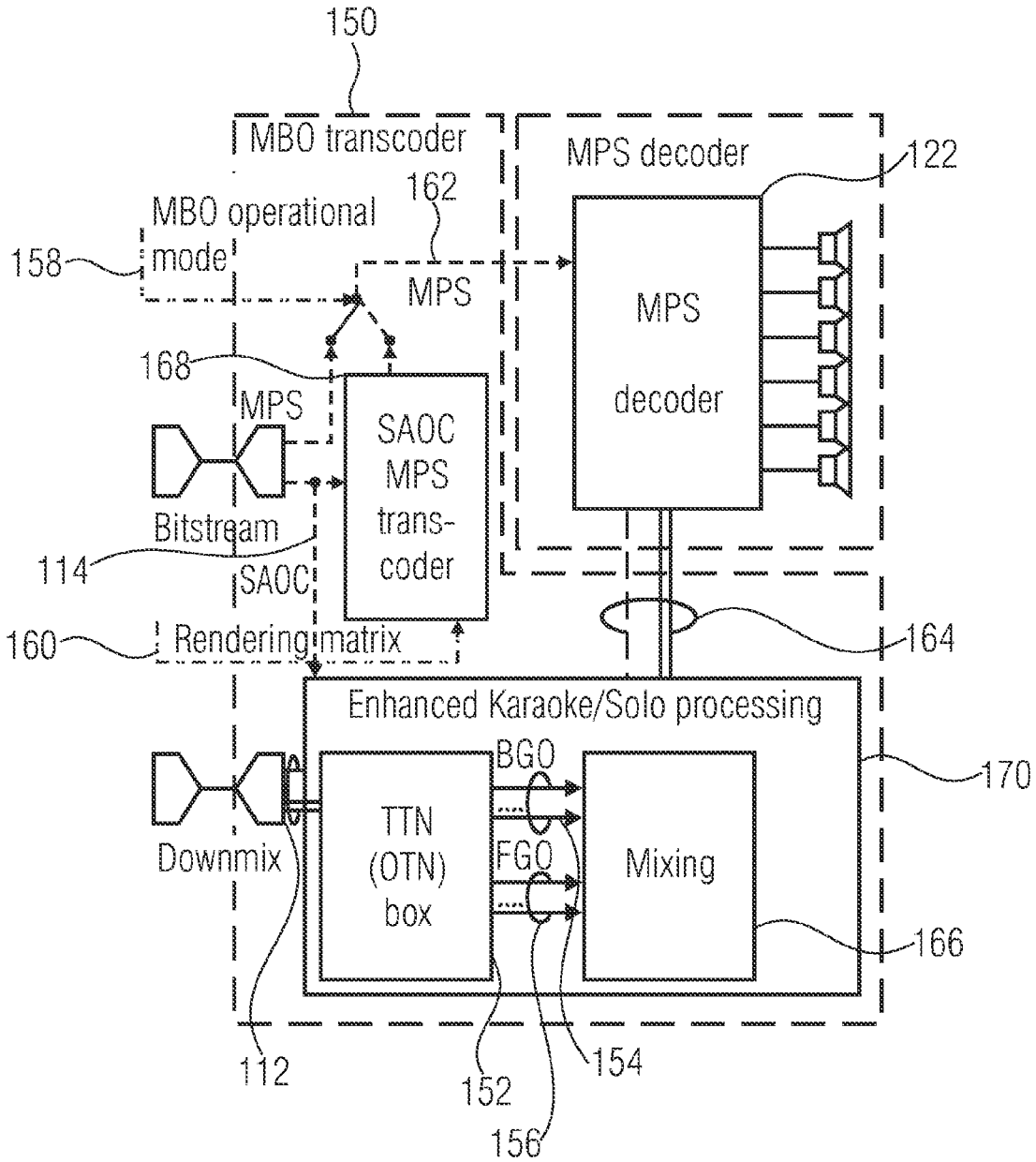
FIG. 14 shows a block diagram of an audio decoder for a Karaoke/Solo mode application, according to an embodiment.

According to this embodiment and FIG. 14, the enhanced Karaoke/Solo transcoder 150 incorporates either a "two-to-N" (TTN) or "one-to-N" (OTN) element 152, both representing a generalized and enhanced modification of the TTT box known from the MPEG Surround specification. The choice of the appropriate element depends on the number of downmix channels transmitted, i.e. the TTN box is dedicated to the stereo downmix signal while for a mono downmix signal the OTN box is applied. The corresponding $TTN^{-1}$ or $OTN^{-1}$ box in the SAOC encoder combines the BGO and FGO signals into a common SAOC stereo or mono downmix 112 and generates the bitstream 114. The arbitrary pre-defined positioning of all individual FGOs in the downmix signal 112 is supported by either element, i.e. TTN or OTN 152. At transcoder side, the BGO 154 or any combination of FGO signals 156 (depending on the operating mode 158 externally applied) is recovered from the downmix 112 by the TTN or OTN box 152 using only the SAOC side information 114 and optionally incorporated residual signals. The recovered audio objects 154/156 and rendering information 160 are used to produce the MPEG Surround bitstream 162 and the corresponding preprocessed downmix signal 164. Mixing unit 166 performs the processing of the downmix signal 112 to obtain the MPS input downmix 164, and MPS transcoder 168 is responsible for the transcoding of the SAOC parameters 114 to MPS parameters 162. TTN/OTN box 152 and mixing unit 166 together perform the enhanced Karaoke/solo mode processing 170 corresponding to means 52 and 54 in FIG. 3 with the function of the mixing unit being comprised by means 54.

An MBO can be treated the same way as explained above, i.e. it is preprocessed by an MPEG Surround encoder yielding a mono or stereo downmix signal that serves as BGO to be input to the subsequent enhanced SAOC encoder. In this case the transcoder has to be provided with an additional MPEG Surround bitstream next to the SAOC bitstream.

Next, the calculation performed by the TTN (OTN) element is explained. The TTN/OTN matrix expressed in a first predetermined time/frequency resolution 42, M, is the product of two matrices $$M = D^{-1}C,$$

where $D^{-1}$ comprises the downmix information and C implies the channel prediction coefficients (CPCs) for each FGO channel. C is computed by means 52 and box 152, respectively, and $D^{-1}$ is computed and applied, along with C, to the SAOC downmix by means and box 152, respectively. The computation is performed according to $$C = \left(\begin{array}{cc|ccc} 1 & 0 & 0 & \dots & 0 \\ 0 & 1 & 0 & \dots & 0 \\ \hline c_{11} & c_{12} & 1 & \dots & 0 \\ \vdots & \vdots & \vdots & \ddots & \vdots \\ c_{N1} & c_{N2} & 0 & \dots & 1 \end{array}\right)$$

for the TTN element, i.e. a stereo downmix and $$C = \left(\begin{array}{c|ccc} 1 & 0 & \dots & 0 \\ \hline c_1 & 1 & \dots & 0 \\ \vdots & \vdots & \ddots & \vdots \\ c_N & 0 & \dots & 1 \end{array}\right)$$

for the OTN element, i.e. a mono downmix.

The CPCs are derived from the transmitted SAOC parameters, i.e. the OLDs, IOCs, DMGs and DCLDs. For one specific FGO channel j the CPCs can be estimated by $$c_{j1} = \frac{P_{LoFo,j}P_{Ro} - P_{RoFo,j}P_{LoRo}}{P_{Lo}P_{Ro} - P_{LoRo}^2}$$

and $$c_{j2} = \frac{P_{RoFo,j}P_{Lo} - P_{LoFo,j}P_{LoRo}}{P_{Lo}P_{Ro} - P_{LoRo}^2}.$$

$$P_{Lo} = OLD_L + \sum_i m_i^2 OLD_i + 2\sum_j m_j \sum_{k=j+1} m_k IOC_{jk}\sqrt{OLD_j OLD_k},$$

$$P_{Ro} = OLD_R + \sum_i n_i^2 OLD_i + 2\sum_j n_j \sum_{k=j+1} n_k IOC_{jk}\sqrt{OLD_j OLD_k},$$

$$P_{LoRo} = IOC_{LR}\sqrt{OLD_L OLD_R} + \sum_i m_i n_i OLD_i + 2\sum_j \sum_{k=j+1} (m_j n_k + m_k n_j) IOC_{jk}\sqrt{OLD_j OLD_k},$$

$$P_{LoFo,j} = m_j OLD_L + n_j IOC_{LR}\sqrt{OLD_L OLD_R} - m_j OLD_j - \sum_{i \neq j} m_i IOC_{ji}\sqrt{OLD_j OLD_i},$$

$$P_{RoFo,j} = n_j OLD_R + m_j IOC_{LR}\sqrt{OLD_L OLD_R} - n_j OLD_j - \sum_{i \neq j} n_i IOC_{ji}\sqrt{OLD_j OLD_i}.$$

The parameters $OLD_L$, $OLD_R$ and $IOC_{LR}$ correspond to the BGO, the remainder are FGO values.

The coefficients $m_j$ and $n_j$ denote the downmix values for every FGO j for the right and left downmix channel, and are derived from the downmix gains DMG and downmix channel level differences DCLD $$m_j = 10^{0.05DMG_j}\sqrt{\frac{10^{0.1DCLD_j}}{1 + 10^{0.1DCLD_j}}}$$

and $$n_j = 10^{0.05DMG_j}\sqrt{\frac{1}{1 + 10^{0.1DCLD_j}}}.$$

With respect to the OTN element, the computation of the second CPC values $c_{12}$ becomes redundant.

To reconstruct the two object groups BGO and FGO, the downmix information is exploited by the inverse of the downmix matrix D that is extended to further prescribe the linear combination for signals $F0_1$ to $F0_N$, i.e.

$$\begin{pmatrix} L0 \\ R0 \\ F0_1 \\ \vdots \\ F0_N \end{pmatrix} = D \begin{pmatrix} L \\ R \\ F_1 \\ \vdots \\ F_N \end{pmatrix}.$$

In the following, the downmix at encoder's side is recited: Within the $TTN^{-1}$ element, the extended downmix matrix is $$D = \left(\begin{array}{cc|ccc} 1 & 0 & m_1 & \dots & m_N \\ 0 & 1 & n_1 & \dots & n_N \\ \hline m_1 & n_1 & -1 & \dots & 0 \\ \vdots & \vdots & 0 & \ddots & \vdots \\ m_N & n_N & 0 & \dots & -1 \end{array}\right)$$

for a stereo BGO, $$D = \left(\begin{array}{c|ccc} 1 & m_1 & \dots & m_N \\ 1 & n_1 & \dots & n_N \\ \hline m_1 + n_1 & -1 & \dots & 0 \\ \vdots & 0 & \ddots & \vdots \\ m_N + n_N & 0 & \dots & -1 \end{array}\right)$$

for a mono BGO, and for the $OTN^{-1}$ element it is $$D = \left(\begin{array}{cc|ccc} 1 & 1 & m_1 & \dots & m_N \\ \hline m_1/2 & m_1/2 & -1 & \dots & 0 \\ \vdots & \vdots & 0 & \ddots & \vdots \\ m_N/2 & m_N/2 & 0 & \dots & -1 \end{array}\right)$$

for a stereo BGO, $$D = \left(\begin{array}{c|ccc} 1 & m_1 & \dots & m_N \\ \hline m_1 & -1 & \dots & 0 \\ \vdots & 0 & \ddots & \vdots \\ m_N & 0 & \dots & -1 \end{array}\right)$$

for a mono BGO.

The output of the TTN/OTN element yields $$\begin{pmatrix} \hat{L} \\ \hat{R} \\ \hline \hat{F}_1 \\ \vdots \\ \hat{F}_N \end{pmatrix} = M \begin{pmatrix} L0 \\ R0 \\ \hline res_1 \\ \vdots \\ res_N \end{pmatrix}$$

for a stereo BGO and a stereo downmix. In case the BGO and/or downmix is a mono signal, the linear system changes accordingly.

The residual signal $res_i$ corresponds to the FGO object i and if not transferred by SAOC stream—because, for example, it lies outside the residual frequency range, or it is signalled that for FGO object i no residual signal is transferred at all—$res_i$ is inferred to be zero. $\hat{F}_i$ is the reconstructed/up-mixed signal approximating FGO object i. After computation, it may be passed through an synthesis filter bank to obtain the time domain such as PCM coded version of FGO object i. It is recalled that L0 and R0 denote the channels of the SAOC downmix signal and are available/signalled in an increased time/frequency resolution compared to the parameter resolution underlying indices (n,k). $\hat{L}$ and $\hat{R}$ are the reconstructed/up-mixed signals approximating the left and right channels of the BGO object. Along with the MPS side bitstream, it may be rendered onto the original number of channels.

According to an embodiment, the following TTN matrix is used in an energy mode.

The energy based encoding/decoding procedure is designed for non-waveform preserving coding of the downmix signal. Thus the TTN upmix matrix for the corresponding energy mode does not rely on specific waveforms, but only describe the relative energy distribution of the input audio objects. The elements of this matrix $M_{Energy}$ are obtained from the corresponding OLDs according to $$M_{Energy} = \begin{pmatrix} \frac{OLD_L}{OLD_L + \sum_i m_i^2 OLD_i} & 0 \\ 0 & \frac{OLD_R}{OLD_R + \sum_i n_i^2 OLD_i} \\ \frac{m_1^2 OLD_1}{OLD_L + \sum_i m_i^2 OLD_i} & \frac{n_1^2 OLD_1}{OLD_R + \sum_i n_i^2 OLD_i} \\ \vdots & \vdots \\ \frac{m_N^2 OLD_N}{OLD_L + \sum_i m_i^2 OLD_i} & \frac{n_N^2 OLD_N}{OLD_R + \sum_i n_i^2 OLD_i} \end{pmatrix}^{\frac{1}{2}}$$

for a stereo BGO,
and $$M_{Energy} = \begin{pmatrix} \frac{OLD_L}{OLD_L + \sum_i m_i^2 OLD_i} & \frac{OLD_L}{OLD_L + \sum_i n_i^2 OLD_i} \\ \frac{m_1^2 OLD_1}{OLD_L + \sum_i m_i^2 OLD_i} & \frac{n_1^2 OLD_1}{OLD_L + \sum_i n_i^2 OLD_i} \\ \vdots & \vdots \\ \frac{m_N^2 OLD_N}{OLD_L + \sum_i m_i^2 OLD_i} & \frac{n_N^2 OLD_N}{OLD_L + \sum_i n_i^2 OLD_i} \end{pmatrix}^{\frac{1}{2}}$$

for a mono BGO,
so that the output of the TTN element yields $$\begin{pmatrix} \hat{L} \\ \hat{R} \\ \hline \hat{F}_1 \\ \vdots \\ \hat{F}_N \end{pmatrix} = M_{Energy} \begin{pmatrix} L0 \\ R0 \end{pmatrix},$$

or respectively $$\begin{pmatrix} \hat{L} \\ \hline \hat{F}_1 \\ \vdots \\ \hat{F}_N \end{pmatrix} = M_{Energy} \begin{pmatrix} L0 \\ R0 \end{pmatrix}.$$

Accordingly, for a mono downmix the energy-based upmix matrix $M_{Energy}$ becomes $$M_{Energy} = \begin{pmatrix} \sqrt{OLD_L} \\ \sqrt{OLD_R} \\ \sqrt{m_1^2 OLD_1} + \sqrt{n_1^2 OLD_1} \\ \vdots \\ \sqrt{m_N^2 OLD_N} + \sqrt{n_N^2 OLD_N} \end{pmatrix} \begin{pmatrix} \frac{1}{\sqrt{OLD_L + \sum_i m_i^2 OLD_i}} + \frac{1}{OLD_R + \sum_i n_i^2 OLD_i} \end{pmatrix}$$

for a stereo BGO, and $$M_{Energy} = \begin{pmatrix} \sqrt{OLD_L} \\ \sqrt{m_1^2 OLD_1} \\ \vdots \\ \sqrt{m_N^2 OLD_N} \end{pmatrix} \begin{pmatrix} \frac{1}{\sqrt{OLD_L + \sum_i m_i^2 OLD_i}} \end{pmatrix}$$

for a mono BGO,
so that the output of the OTN element results in.

$$\begin{pmatrix} \hat{L} \\ \hat{R} \\ \hline \hat{F}_1 \\ \vdots \\ \hat{F}_N \end{pmatrix} = M_{Energy}(L0),$$

or respectively $$\begin{pmatrix} \hat{L} \\ \hline \hat{F}_1 \\ \vdots \\ \hat{F}_N \end{pmatrix} = M_{Energy}(L0).$$

Thus, according to the just mentioned embodiment, the classification of all objects ($Obj_1, \ldots Obj_N$) into BGO and FGO, respectively, is done at encoder's side. The BGO may be a mono (L) or stereo $$\begin{pmatrix} L \\ R \end{pmatrix}$$

object. The downmix of the BGO into the downmix signal is fixed. As far as the FGOs are concerned, the number thereof is theoretically not limited. However, for most applications a total of four FGO objects seems adequate. Any combinations of mono and stereo objects are feasible. By way of parameters $m_i$ (weighting in left/mono downmix signal) and $n_i$ (weighting in right downmix signal), the FGO downmix is variable both in time and frequency. As a consequence, the downmix signal may be mono (L0) or stereo $$\begin{pmatrix} L0 \\ R0 \end{pmatrix}.$$

Again, the signals $(F0_1 \ldots F0_N)^T$ are not transmitted to the decoder/transcoder. Rather, same are predicted at decoder's side by means of the aforementioned CPCs.

In this regard, it is again noted that the residual signals res may even be disregarded by a decoder. In this case, a decoder—means 52, for example—predicts the virtual signals merely based in the CPCs, according to:

Stereo Downmix:

$$\begin{pmatrix} L0 \\ R0 \\ \hline \hat{F}0_1 \\ \vdots \\ \hat{F}0_N \end{pmatrix} = C\begin{pmatrix} L0 \\ R0 \end{pmatrix} = \begin{pmatrix} 1 & 0 \\ 0 & 1 \\ \hline c_{11} & c_{12} \\ \vdots & \vdots \\ c_{N1} & c_{N2} \end{pmatrix}\begin{pmatrix} L0 \\ R0 \end{pmatrix}$$

Mono Downmix:

$$\begin{pmatrix} L0 \\ \hline \hat{F}0_1 \\ \vdots \\ \hat{F}0_N \end{pmatrix} = C(L0) = \begin{pmatrix} 1 \\ \hline c_{11} \\ \vdots \\ c_{N1} \end{pmatrix}(L0).$$

Then, BGO and/or FGO are obtained by—by, for example, means 54—inversion of one of the four possible linear combinations of the encoder, for example, $$\begin{pmatrix} \hat{L} \\ \hat{R} \\ \hline \hat{F}_1 \\ \vdots \\ \hat{F}_N \end{pmatrix} = D^{-1}\begin{pmatrix} L0 \\ R0 \\ \hline \hat{F}0_1 \\ \vdots \\ \hat{F}0_N \end{pmatrix},$$

where again $D^{-1}$ is a function of the parameters DMG and DCLD.

Thus, in total, a residual neglecting TTN (OTN) Box 152 computes both just-mentioned computation steps for example:

$$\begin{pmatrix} \hat{L} \\ \hat{R} \\ \hline \hat{F}_1 \\ \vdots \\ \hat{F}_N \end{pmatrix} = D^{-1}C\begin{pmatrix} L0 \\ R0 \end{pmatrix}.$$

It is noted, that the inverse of D can be obtained straightforwardly in case D is quadratic. In case of a non-quadratic matrix D, the inverse of D shall be the pseudo-inverse, i.e. $\mathrm{pinv}(D)=D^*(DD^*)^{-1}$ or $\mathrm{pinv}(D)=(D^*D)^{-1}D^*$. In either case, an inverse for D exists.

Finally, FIG. 15 shows a further possibility how to set, within the side information, the amount of data spent for transferring residual data. According to this syntax, the side information comprises bsResidualSamplingFrequencyIndex, i.e. an index to a table associating, for example, a frequency resolution to the index. Alternatively, the resolution may be inferred to be a predetermined resolution such as the resolution of the filter bank or the parameter resolution. Further, the side information comprises bsResidualFramesPerSAOCFrame defining the time resolution at which the residual signal is transferred. BsNumGroupsFGO also comprised by the side information, indicates the number of FGOs. For each FGO, a syntax element bsResidualPresent is transmitted, indicating as to whether for the respective FGO a residual signal is transmitted or not. If present, bsResidualBands indicates the number of spectral bands for which residual values are transmitted.

Depending on an actual implementation, the inventive encoding/decoding methods can be implemented in hardware or in software. Therefore, the present invention also relates to a computer program, which can be stored on a computer-readable medium such as a CD, a disk or any other data carrier. The present invention is, therefore, also a computer program having a program code which, when executed on a computer, performs the inventive method of encoding or the inventive method of decoding described in connection with the above figures.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A Spatial audio object coding (SAOC) decoder for decoding a SAOC stereo downmix signal, SAOC side information and a residual coding, the SAOC stereo downmix signal being a combination of a stereo object signal forming first and second audio signals, and a mono object signal forming a third audio signal, the SAOC side information comprising object energy ratios for each of the first, second, and third audio signals and inter-signal correlation between the first and second audio signals, and the residual coding being provided to enhance an up-mix reconstruction quality, the SAOC decoder comprises a hardware implementation including:

a calculating device arranged to calculate channel prediction coefficients from the object energy ratios and the inter-signal correlation; and a reconstructing device arranged to up-mix reconstruct the first and second audio signals and/or the third audio signal from the SAOC stereo downmix signal using the channel prediction coefficients and the residual coding; wherein the SAOC side information further comprises a downmix matrix, entries of which indicate a weight by which the first, second, and third audio signals contribute to left and right downmix channels of the SAOC stereo downmix signal by summation;

the first audio signal contributes to the left downmix channel while not contributing to the right downmix channel, the second audio signal contributes to the right downmix channel while not contributing to the left downmix channel, and the third audio signal contributes to both the left and right downmix channels;

the SAOC decoder is configured to perform the up-mix reconstruction further using the downmix matrix; and the SAOC decoder is configured to perform the up-mix reconstruction using $$\begin{pmatrix} \hat{L} \\ \hat{R} \\ S_2 \end{pmatrix} = D^{-1}\left\{\begin{pmatrix} 1 \\ C \end{pmatrix} d + H\right\}$$

where $\hat{L}$ is a reconstruction of the first audio signal, $\hat{R}$ is a reconstruction of the second audio signal, $S_2$ is a reconstruction of the third audio signal, d is the SAOC stereo downmix signal with $$d = \begin{pmatrix} d_1 \\ d_2 \end{pmatrix},$$

with $d_1$ being the left downmix channel and $d_2$ being the right downmix channel, the "1" is a 2×2 identity matrix, D is the downmix matrix, H is $$H = \begin{pmatrix} 1 \\ 1 \\ res \end{pmatrix}$$

with res being a residual signal represented by the residual coding, and C being a prediction coefficient matrix C consisting of the channel prediction coefficients.

2. The SAOC decoder according to claim 1, wherein the downmix matrix varies in time within the SAOC side information.

3. The SAOC decoder according to claim 1, wherein the downmix matrix varies in time within the side information at a time resolution coarser than a frame-size.

4. Method for decoding a SAOC stereo downmix signal, SAOC side information and a residual coding, the SAOC stereo downmix signal being a combination of a stereo object signal forming first and second audio signals, and a mono object signal forming a third audio signal, the SAOC side information comprising object energy ratios for each of the first, second, and third audio signals and inter-signal correlation between the first and second audio signals, and the residual coding being provided to enhance an up-mix reconstruction quality, the method comprising:

calculating channel prediction coefficients from the object energy ratios and the inter-signal correlation; and up-mix reconstructing the first and second audio signals and/or the third audio signal from the SAOC stereo downmix signal using the channel prediction coefficients and the residual coding; wherein the SAOC side information further comprises a downmix matrix, entries of which indicate a weight by which the first, second, and third audio signals contribute to left and right downmix channels of the SAOC stereo downmix signal by summation;

the first audio signal contributes to the left downmix channel while not contributing to the right downmix channel, the second audio signal contributes to the right downmix channel while not contributing to the left downmix channel, and the third audio signal contributes to both the left and right downmix channels;

the up-mix reconstruction is performed further using the downmix matrix; and the up-mix reconstruction uses $$\begin{pmatrix} \hat{L} \\ \hat{R} \\ S_2 \end{pmatrix} = D^{-1}\left\{\begin{pmatrix} 1 \\ C \end{pmatrix} d + H\right\}$$

where $\hat{L}$ is a reconstruction of the first audio signal, $\hat{R}$ is a reconstruction of the second audio signal, $S_2$ is a reconstruction of the third audio signal, d is the SAOC stereo downmix signal with $$d = \begin{pmatrix} d_1 \\ d_2 \end{pmatrix}$$

with $d_1$ being the left downmix channel and $d_2$ being the right downmix channel, the "1" is a 2×2 identity matrix, D is the downmix matrix, H is $$H = \begin{pmatrix} 1 \\ 1 \\ res \end{pmatrix}$$

with res being a residual signal represented by the residual coding, and C being a prediction coefficient matrix C consisting of the channel prediction coefficients.

5. The method for decoding a SAOC stereo downmix signal according to claim 4, wherein the downmix matrix varies in time within the SAOC side information.

6. The method for decoding a SAOC stereo downmix signal according to claim 4, wherein the downmix matrix varies in time within the side information at a time resolution coarser than a frame-size.

7. A non-transitory computer-readable medium having stored thereon a computer program with a program code for executing, when running on a processor, a method for decoding a SAOC stereo downmix signal, SAOC side information and a residual coding, the SAOC stereo downmix signal being a combination of a stereo object signal forming first and second audio signals, and a mono object signal forming a third audio signal, the SAOC side information comprising object energy ratios for each of the first, second, and third audio signals and inter-signal correlation between the first and second audio signals, and the residual coding being provided to enhance an up-mix reconstruction quality, the method comprising:

calculating channel prediction coefficients from the object energy ratios and the inter-signal correlation; and up-mix reconstructing the first and second audio signals and/or the third audio signal from the SAOC stereo downmix signal using the channel prediction coefficients and the residual coding; wherein the SAOC side information further comprises a downmix matrix, entries of which indicate a weight by which the first, second, and third audio signals contribute to left and right downmix channels of the SAOC stereo downmix signal by summation;

the first audio signal contributes to the left downmix channel while not contributing to the right downmix channel, the second audio signal contributes to the right downmix channel while not contributing to the left downmix channel, and the third audio signal contributes to both the left and right downmix channels;

the up-mix reconstruction is performed further using the downmix matrix; and the up-mix reconstruction uses $$\begin{pmatrix} \hat{L} \\ \hat{R} \\ S_2 \end{pmatrix} = D^{-1}\left\{\begin{pmatrix} 1 \\ C \end{pmatrix} d + H\right\},$$

where $\hat{L}$ is a reconstruction of the first audio signal, $\hat{R}$ is a reconstruction of the second audio signal, $S_2$ is a reconstruction of the third audio signal, d is the SAOC stereo downmix signal with $$d = \begin{pmatrix} d_1 \\ d_2 \end{pmatrix}$$

with $d_1$ being the left downmix channel and $d_2$ being the right downmix channel, the "1" is a 2×2 identity matrix, D is the downmix matrix, H is $$H = \begin{pmatrix} 1 \\ 1 \\ res \end{pmatrix}$$

with res being a residual signal represented by the residual coding, and C being a prediction coefficient matrix C consisting of the channel prediction coefficients.

* * * * *